US005609397A

United States Patent [19]

Marshall et al.

[11] Patent Number: 5,609,397

[45] Date of Patent: Mar. 11, 1997

[54] HIGHWALL MINING SYSTEM WITH DRIVEN CONVEYOR UNITS

[75] Inventors: Gordon A. Marshall, Camberwell; Rene P. Abela, New South Wales; Henry J. Bartosiewicz, Mount Waverley, all of Australia

[73] Assignee: The Broken Hill Proprietary Company Limited, Melbourne, Australia

[21] Appl. No.: 272,547

[22] Filed: Jul. 11, 1994

[30] Foreign Application Priority Data

Jul. 12, 1993 [AU] Australia ..... PL 9888
Apr. 29, 1994 [AU] Australia ..... PM 5380

[51] Int. Cl.[6] ..... E21C 29/00; B61G 5/10

[52] U.S. Cl. ..... 299/67; 105/3; 198/303; 213/1.3

[58] Field of Search ..... 299/18, 56, 57, 299/64, 67; 198/303, 594; 105/3; 213/1.3, 75 B, 75 R

[56] References Cited

U.S. PATENT DOCUMENTS

| | | | |
|---|---|---|---|
| 2,780,451 | 2/1957 | Alspaugh et al. | 299/18 |
| 2,826,402 | 3/1958 | Alspaugh et al. | 299/1.4 |
| 3,135,502 | 6/1964 | Muehlman | 299/56 |
| 3,552,580 | 1/1971 | Cope | 213/1.3 |
| 3,591,017 | 7/1971 | Cope et al. | 213/1.3 X |
| 4,014,574 | 3/1977 | Todd | 299/1.4 |
| 4,953,915 | 9/1990 | Jassar et al. | 299/18 |
| 5,232,269 | 8/1993 | Addington et al. | 299/67 |

FOREIGN PATENT DOCUMENTS

| | | |
|---|---|---|
| 88968/91 | 6/1992 | Australia . |
| 91272/91 | 8/1992 | Australia . |

*Primary Examiner*—David J. Bagnell
*Attorney, Agent, or Firm*—Larson and Taylor

[57] ABSTRACT

A highwall mining system for mining aggregate material from a seam includes both a mining device for cutting aggregate material from the seam and thereby forming a drive in the seam and a conveying device for conveying mined aggregate material from the drive. The conveying device is formed of a plurality of modular conveyor units having a mechanism for releasably coupling together the conveyor units. A driving device is used for driving the mining device and the conveyor device into the seam to form the drive. A controlling device is employed to control forward movement of the mining device and the conveying device so that the mining device and the conveying device can move together at a predetermined rate of advance into the seam without there being any uncontrolled forward movement of the mining device and/or the conveying device in response to the incline of the seam and/or during the addition of a new conveyor unit to the conveying device.

37 Claims, 17 Drawing Sheets

HIGHWALL MINING SYSTEM WITH DRIVEN CONVEYOR UNITS

The present invention relates to highwall mining of aggregate material.

The present invention relates particularly, although by no means exclusively, to a highwall mining system for mining coal from a seam extending from an exposed face in a wall of an open cut mine.

In basic terms, the known highwall mining systems comprise a mining means for cutting coal from a seam to form a drive, a conveying means for conveying coal from the drive, and a driving means for driving the mining means and the conveying means into the seam and thereafter from the drive.

Highwall mining of coal offers the potential for low cost recovery of coal that cannot normally be recovered economically by conventional surface or underground mining operations.

One of the earliest highwall mining systems is disclosed in U.S. Pat. No. 2,826,402 of Alspaugh et al. In the Alspaugh system the driving means for the mining means and the conveying means is coupled to the mining means. In addition, the conveying means comprises a plurality of modular conveyor units releasably coupled together. Furthermore, the Alspaugh system includes a launch vehicle positioned at the entry of the drive, and the launch vehicle includes a conveyor unit addition assembly which lifts a new conveyor unit into position behind the rearmost conveyor unit of the conveying means so that the new conveyor unit can then be coupled to the rearmost conveyor unit. It is necessary to stop the forward movement of the mining means and the conveying means in order to add a new conveyor unit to the conveying means.

In each of the highwall mining systems disclosed in U.S. Pat. No. 2,780,451 of Alspaugh et al and U.S. Pat. No. 3,135,502 of Muehlman, the driving means for the mining means. However, in each case, the conveyor units are coupled together into a continuous train and there is no need for a conveyor unit addition assembly of the type proposed in Alspaugh U.S. Pat. No. 2,826,402.

As the highwall mining industry has developed there has been an increasing recognition that it is preferable that the driving means be located outside rather than inside a drive. As a consequence, the coupling together of the conveyor units has become a more important consideration in order to ensure effective transfer of the force applied by the driving means to the mining means and to ensure directional control of the mining means and the conveying means.

In Australian patent accept No. 638,367 (or Doc. No. Au-B- 88968/91) and patent application accept. No. 644,257 (or Doc. No. Au-B-91272/91) of Addington Resources, Inc. the conveyor units are of the same general type as proposed by Alspaugh, Muehlman, and others, and the conveyor units comprise a framework mounted on a wheel assembly and a belt conveyor extending the length of the conveyor unit. The conveyor units are also characterised by a clevis and tongue assembly to couple together the conveyor units. The clevis/tongue assembly requires a removable locking pin to be manually inserted to complete the assembly and to couple together the conveyor units. Similarly, it is necessary that the locking pin be manually removed from the clevis/tongue assembly to uncouple the conveyor units. The clevis/tongue assembly forms a semi-rigid coupling which limits relative sideways movement of the conveyor units and thus provides a reasonable degree of directional control.

The driving means disclosed in Addington patent application 644,257 comprises two sets of tandem drive cylinders, each set having one drive cylinder on each side of the conveying means, and the drive cylinders on each side of the conveying means being longitudinally aligned and spaced apart. The arrangement is such that the two sets of drive cylinders act co-operatively as a "walking" system to advance by pushing the mining means and the conveying means. The pushing force is transferred from the drive cylinders to the mining means and the conveying means via "pusher arms" coupled to the drive cylinders which are arranged to bear against lugs extending from the sides of the conveying means. A disadvantage of the driving means, which also applies to the driving means disclosed in Addington patent 638,367, is that when pushing forward there is no positive control which prevents unwanted forward movement of the mining means and the conveying means as may occur, by way of example, in dipping seams.

In U.S. Pat. No. 4,014,574 of Todd, the conveyor units are of a different construction and comprise rigid box sections which transfer to a mining means the force applied by a driving means located on a launch vehicle. A new conveyor unit can only be added to the conveying means by disengaging and withdrawing the driving means to allow a new conveyor unit to be positioned and coupled to the rearmost conveyor unit of the conveying means and to the driving means. This is a disadvantage because it necessitates an interruption to the cutting and conveying of aggregate material. Additionally, when mining dipping seams, the conveying means and the mining means rely solely on friction with the ground to maintain their position while the driving means is disengaged to add a new conveyor unit.

An object of the present invention is to provide a highwall mining system which alleviates at least some of the disadvantages of the known highwall mining systems described in the preceding paragraphs.

According to the present invention there is provided a highwall mining system for mining aggregate material from a seam comprising:

(a) a mining means for cutting aggregate material from the seam and thereby forming a drive in the seam;

(b) a conveying means for conveying mined aggregate material from the drive, the conveying means comprising a plurality of modular conveyor units having a means for releasably coupling together the conveyor units; and (c) a driving means for driving the mining means and the conveying means into the seam to form the drive.

It is preferred that the coupling means of the highwall mining system be formed to allow limited relative rotation of adjacent conveyor units about a horizontal axis that is perpendicular to a longitudinal axis of the conveying means and substantially no relative rotation about a vertical axis.

It is preferred particularly that the coupling means also be formed to allow limited relative rotation of adjacent conveyor units about the longitudinal axis of the conveying means.

It is preferred more particularly that the coupling means be formed to allow substantially no relative translation of adjacent conveying units in longitudinal, horizontal and vertical directions.

It can readily be appreciated that such an arrangement allows a pushing force to be transferred from conveyor unit to conveyor unit along the length of the conveying means to move the conveying means forward without jackknifing or buckling the conveyor units while allowing angular displacement in a vertical plane to allow the conveying means to follow the contours of the drive and to transfer a controlled pushing force on to the back of the mining means to increase or provide the "sumping" forces for the cutting and mining of aggregate material.

It can also readily be appreciated that such an arrangement minimises free-play in the general longitudinal direction of the conveying means and the mining means and hence the direction of advance. The minimizing of free-play is advisable to control the position and straight alignment of the conveying means and the mining means and to control the forces acting on and in them. For example, the axial force within the conveying means may change from tension to compression or from compression to tension in the course of excavation of one drive due to changes in the seam incline angle, the number of conveyor units used, and/or the mining means operation, such as from "sumping" to "shearing".

It is preferred that the limited relative rotation be no more than 20°.

It is preferred particularly that the limited relative rotation be no more than 8°.

The term "substantially no relative rotation" is understood herein in the context of normal engineering tolerances and working clearances in the coal mining industry.

It is preferred that the mining means and the conveyor units comprise a means of the type described above for releasably coupling together the mining means and the conveyor units.

It is preferred that each conveyor unit of the highwall mining system comprise a belt or a chain conveyor extending over the length of the conveyor unit.

It is preferred that each conveyor unit comprise a wheel assembly.

It is preferred particularly that each conveyor unit comprises a single wheel assembly.

It is preferred that each conveyor unit be adapted to accommodate transverse slope of the drive.

It is preferred that the coupling means comprise a male member and a complementary female member connected to the conveyor units such that the male member of one conveyor unit can be releasably received in the female member of an adjacent conveyor unit to couple together the conveyor units.

It is preferred that each male member be coupled to an associated conveyor unit for pivotal movement about a horizontal axis of the conveyor unit.

It is preferred particularly that the horizontal axis be coincident with or in the region of the axis of the wheel assembly.

It is preferred particularly that the horizontal axis be coincident with the axis of the wheel assembly.

It is preferred that each male member and each female member comprise cut-out sections that are arranged so that when the male member of one conveyor unit is received in the female member of an adjacent conveyor unit the cut-out sections form an opening that is transverse to the longitudinal direction of the conveying means.

With such an arrangement, it is preferred that the coupling means further comprise a locking pin that is moveable into the opening thereby to prevent disengagement of the male and the female members.

It is preferred that the cut-out sections form a circular opening.

It is preferred that the coupling means comprise a means for moving the locking pin into and from locking engagement in the opening. It is noted that the locking pin moving means may be actuated manually or automatically.

It is preferred that the coupling means comprise a pair of the male members on each side at one end and a pair of the female members on each side at the other end of each conveyor unit.

With such an arrangement, it is preferred that the openings formed when, in use, the male members of one conveyor unit are received in the female members of an adjacent conveyor unit be aligned.

It is preferred that the highwall mining system further comprises a means for electrically coupling a new conveyor unit to the end conveyor unit of the conveying means automatically as the male members of one conveyor unit are received in the female members of the other conveyor unit.

It is preferred that the highwall mining system further comprises a control circuit for actuating the supply of electrical power to the new conveyor unit after a series of pre-conditions for supply have been met.

It is noted that the supply of electrical power may be manually or automatically actuated via the control circuit.

It is preferred that the highwall mining system further comprise a controlling means for controlling forward movement of the mining means and the conveying means so that the mining means and the conveying means can move forward together at a predetermined rate of advance into the seam without there being any uncontrolled forward movement of the mining means and/or the conveying means in response to the incline of the seam and/or during the addition of a new conveyor unit to the conveying means.

The controlling means is an important feature of the present invention in order to operate the highwall mining system in a dipping seam where it is necessary that the mining means and the conveying means move forward together in a controlled way. It is an important feature, by way of example, in order to avoid the risk that the conveying means, when on an inclined surface, may apply excessive force onto the back of and thereby jam or damage the mining means. It is also an important feature in order to prevent uncontrolled forward movement of the mining means on an inclined surface that may result in uncontrolled cutting of aggregate material and unwanted reaction forces acting on the mining means due to the mining means engaging the seam.

The controlling means is also an important feature in order to control or restrain the conveying means and the mining means, not only while advancing, but also on withdrawal and/or while stationary and/or while adding or removing conveyor units to extend or shorten the length of the conveying means so that maintaining the position of the conveying means and mining means does not rely only on friction between the conveying means and the mining means and the ground.

The term "dipping seam" is understood herein to mean a seam that is inclined downwardly or upwardly at an average angle of incline of at least 4° to the horizontal over the length of the seam and/or in the region of the seam where highwall mining is to be utilised.

It is noted that the term "dipping seam" is understood herein to cover seams which undulate and have sections which are horizontal or slightly inclined (upwardly or downwardly) provided that over the length of the seam there is an average angle of incline downwardly or upwardly of at least 4°.

It is also noted that the direction of advance of highwall mining into the seam is understood to be generally in the direction of the downward incline of the dipping seam and typically at, but not limited to, a right angle to the general direction of the highwall where the seam is exposed.

It is preferred that the controlling means be located externally to the drive.

It is preferred that the driving means of the highwall mining system be located externally to the drive and arranged for pushing the mining means and the conveying means into the seam and for pulling the mining means and the conveying means from the drive.

It is preferred that the mining means of the highwall mining system be a continuous miner and that the driving means further comprises the continuous miner.

It is preferred that the mining means be a high capacity continuous miner.

It is preferred that the mining means be a continuous miner of the type comprising, a plurality of cutting picks on a rotatable cutting drum mounted on the end of a boom that is supported for pivotal movement about a horizontal axis.

It is preferred particularly that the mining means be remotely controlled and tele-operated from outside the drive.

In addition, it is preferred particularly that the mining means have side pusher pads for steering and bottom pusher pads for transverse levelling.

It is preferred that the highwall mining system comprise a launch platform adapted to be positioned at the entrance to the drive.

It is preferred that the launch platform comprise the controlling means.

In addition, or alternatively, it is preferred that the launch platform comprise the driving means.

It is preferred that the launch platform further comprises a launch platform conveyor for receiving and discharging aggregate material from the end of the conveying means.

It is preferred that the controlling means and the driving means be combined together.

In one arrangement, it is preferred that the combined driving/controlling means comprise a rack and pinion drive assembly.

With such an arrangement, it is preferred that the rack and pinion drive assembly comprises a rack bar mounted to at least one side of the mining means and each conveyor unit and a drive pinion on the launch platform for engaging the rack bar.

It is preferred that the drive pinion be hydraulically driven.

It is preferred that the rack and pinion drive assembly comprise a plurality of the drive pinions spaced apart in a line.

It is preferred that the rack and pinion drive assembly comprise a rack bar on both sides of each conveyor unit and a plurality of drive pinions for engaging each rack bar.

In an alternative arrangement, it is preferred that the combined driving/controlling means comprise a sliding plate assembly having a plate member located for sliding movement below the mining means and the conveyor units on the launch platform and a drive means for sliding the plate member, with the plate member comprising a means for engaging the mining means and/or one of the conveyor units of the conveying means and/or a new conveyor unit to be added to the conveying means.

In an alternative arrangement, it is preferred that the combined driving/controlling means comprises two sets of tandem drive cylinders, each set having one drive cylinder on each side of the conveying means, and the drive cylinders on each side of the conveying means being longitudinally aligned and spaced apart.

It is preferred that the driving/controlling means further comprises a means for engaging one of the conveyor units coupled to each drive cylinder.

It is preferred that the engaging means comprises a locking plate which is movable between an extendable position at which the locking plate engages a lug extending from a side of the conveyor unit and a retracted position at which the locking plate is clear of the lug, and the locking plate comprises a recess for receiving the lug.

It is preferred that the two sets of drive cylinders act co-operatively as a "walking" system to advance by pushing, and to withdraw by pulling, the mining means and the conveying means. With such an arrangement, during advance into the seam, and similarly on withdrawal from the seam, the two sets of drive cylinders act cyclically so that one set retracts while the other set controls the advance rate of the mining means and the conveying means.

Alternatively, the combined driving/controlling means may comprise reciprocating drive cylinders and/or sets of linear tracks, linear and/or rotary drives, chains, cables or other mechanical devices driven by electric or hydraulic means.

It is preferred that the launch platform comprise an anchoring means to releasably anchor the launch platform against a pit floor and/or a highwall to react against pushing and pulling forces generated on the launch platform.

By way of example, the anchoring means may comprise:

(a) grouser plates supporting the base of the launch platform;

(b) ground engaging pins on the launch platform; and (c) means of reacting back into the highwall at its toe and above the seam.

It is preferred that the launch platform comprise self-propelled tracks for mobility. It is noted that the tracks may act as a form of the anchoring means.

It is preferred that the launch platform comprise an extensible and/or removable front for providing a supporting structure for the mining means and the conveying means between the launch platform and the drive entry.

It is preferred that the launch platform comprise a means for adjusting the angle of inclination of the launch platform or part thereof, such as hydraulic jacks, so that the launch platform or part thereof can be adjusted to be:

(a) substantially horizontal, for example, for operations such as maintenance; or (b) inclined at an angle suitable for entry of the mining means and the conveying means into a drive in a dipping seam.

It is preferred that the highwall mining system further comprise a means for adding conveyor units to the conveyor train.

In this connection, it is preferred that the launch platform comprise, a guide track or guide rollers for guiding additional conveyor units in turn to the end of the conveying means and into the drive, and delivery/discharge platforms on opposite sides of the guide track or guide rollers for storing conveyor units prior to addition to or after removal from the conveying means.

It is preferred that the launch platform further comprises pinch rollers to engage each conveyor unit being added/removed from the conveying means to align, guide, control and drive the conveyor unit while on the launch platform.

It can readily be appreciated that the pinch rollers provide a means of preventing uncontrolled movement of the conveyor units in response to the inclination of the launch platform.

It is preferred that the delivery/discharge platforms prevent uncontrolled movement of the conveyor units while supporting the conveyor units. As a consequence, it may be possible to stack more than one conveyor unit on each of the delivery/discharge platforms.

It is preferred that the conveyor unit addition means comprise an overhead crane or other suitable means mounted on the launch platform for selectively transferring conveyor units from the delivery/discharge platforms to the end of the conveying means and from the end of the conveying means to the delivery/discharge platforms.

It is preferred that the overhead crane, or other suitable means, has sufficient rigidity and holds the conveyor unit in such a manner as to prevent uncontrolled movement of the conveyor units while being handled by the crane.

It is preferred that the launch platform be adapted to receive delivery or discharge of conveyor units from either side of the launch platform conveyor and comprise a means for preventing uncontrolled movement of the conveyor units not coupled to the conveying means but supported by the launch platform.

It is preferred that the highwall mining system further comprise a loading/unloading machine for transferring conveyor units between the launch platform and the pit area.

It is preferred particularly that the loading/unloading machine be a wheeled or tracked machine with a loading head for lifting and engaging the conveyor units in such a manner as to prevent uncontrolled movement of one or more conveyor units while being handled by the machine.

In addition, it is preferred that the loading head be adjustable to tilt longitudinally and/or transversely and/or rotate about a horizontal and/or a vertical axis to handle the conveyor units. These loading head motions are particularly desirable where the loading/unloading machine is operating on a different inclined angle to the inclined angle of the launch platform.

It is preferred that the launch platform comprise safety hand rails or fences or other safety devices along both sides of the launch platform conveyor.

It is preferred particularly that the hand rails or fences be removable or have openings or moving sections, such as sliding gates, to allow access for the loading/unloading of the conveyor units over the belly conveyor directly by the loading machine or other means.

It is preferred that the highwall mining system further comprises:

(a) a circulation means located on or in the region of the mining means for circulating the atmosphere at least at the forward end of the drive;

(b) an inertization means for maintaining the concentration of oxygen in the atmosphere in the drive lower than the concentration of oxygen required for explosion of methane gas and/or dusts and/or other flammable materials in the drive, the inertization means comprising:

(i) an inertization gas injection means for injecting an inertization gas into the drive, the inertization gas injection means having an outlet for inertization gas located during the early stages of forming the drive (a) on or in the region of the mining means and, thereafter, (b) on or in the region of the mining means and/or at the entrance of the drive and/or between the entrance of the drive and the mining means; and (ii) a barrier means to restrict gas flow into and from the drive.

The term "inertization gas" is understood to mean a gas that contains either no oxygen or a concentration of oxygen that is low enough to maintain the concentration of oxygen in the drive below that required for explosion of methane gas and/or dusts and/or other flammable materials in a drive.

It is noted that the circulation means and the inertization means are described in more detail in Australian provisional applications PL9888 and PM5081 of the applicant and the disclosure in the provisional applications is incorporated herein by reference.

The present invention is described hereinafter by way of example with reference to the accompanying drawings, in which.

Figure 7:
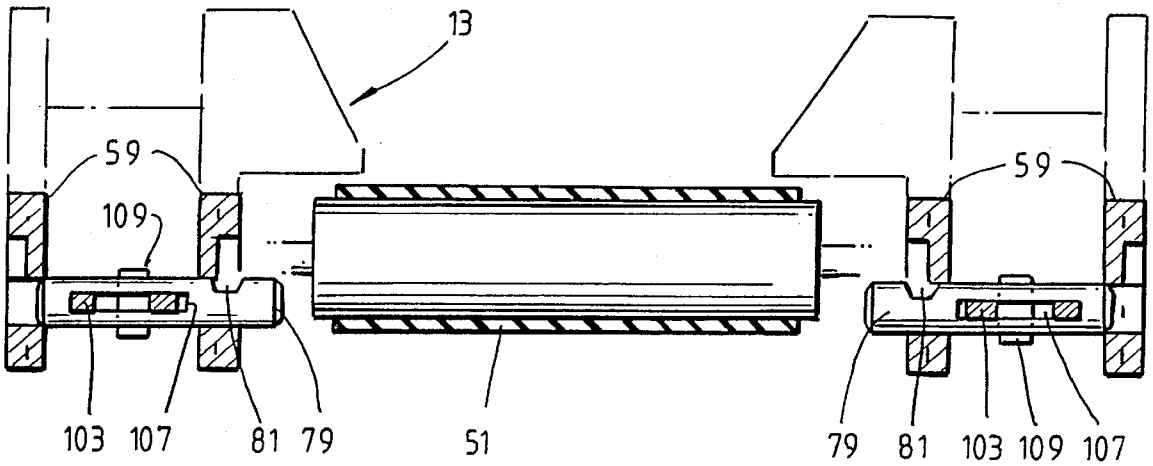
FIG. 7 is a section along the line 7—7 in FIG. 4.
Figure 8:
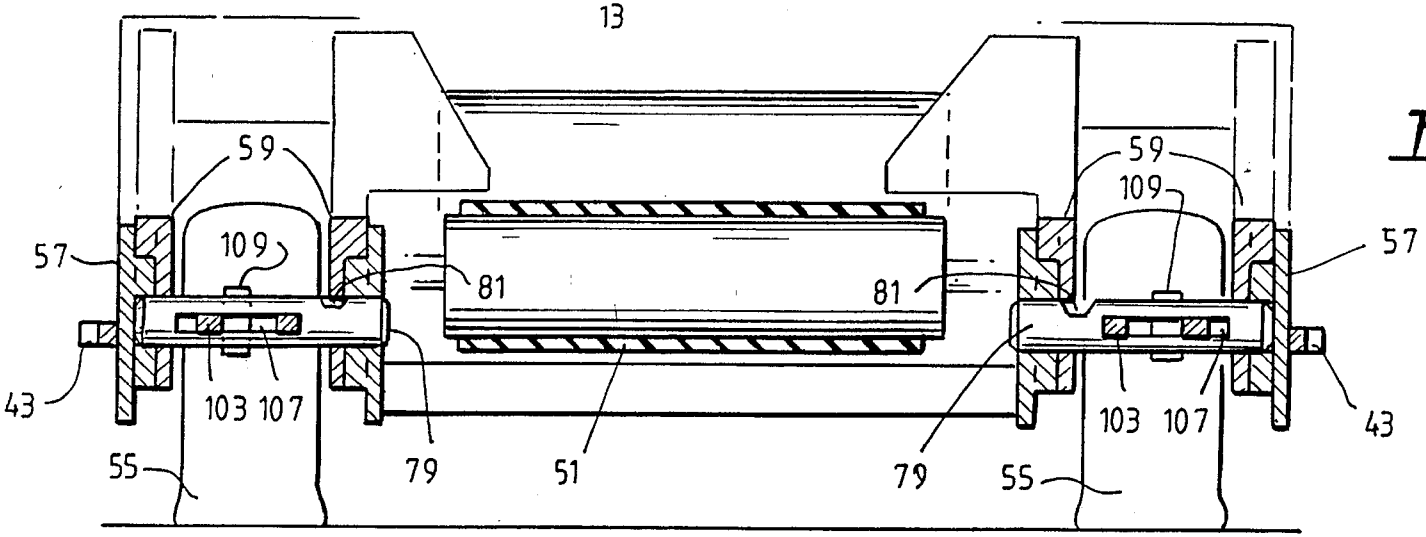
FIG. 8 is a section along the line 8—8 in FIG. 5.
Figure 15:
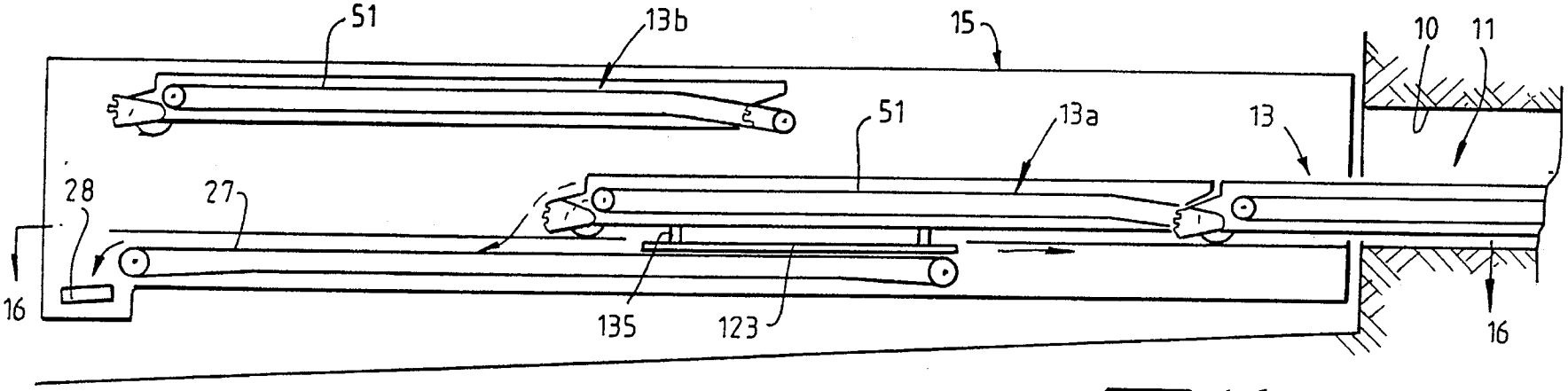
Figure 16:
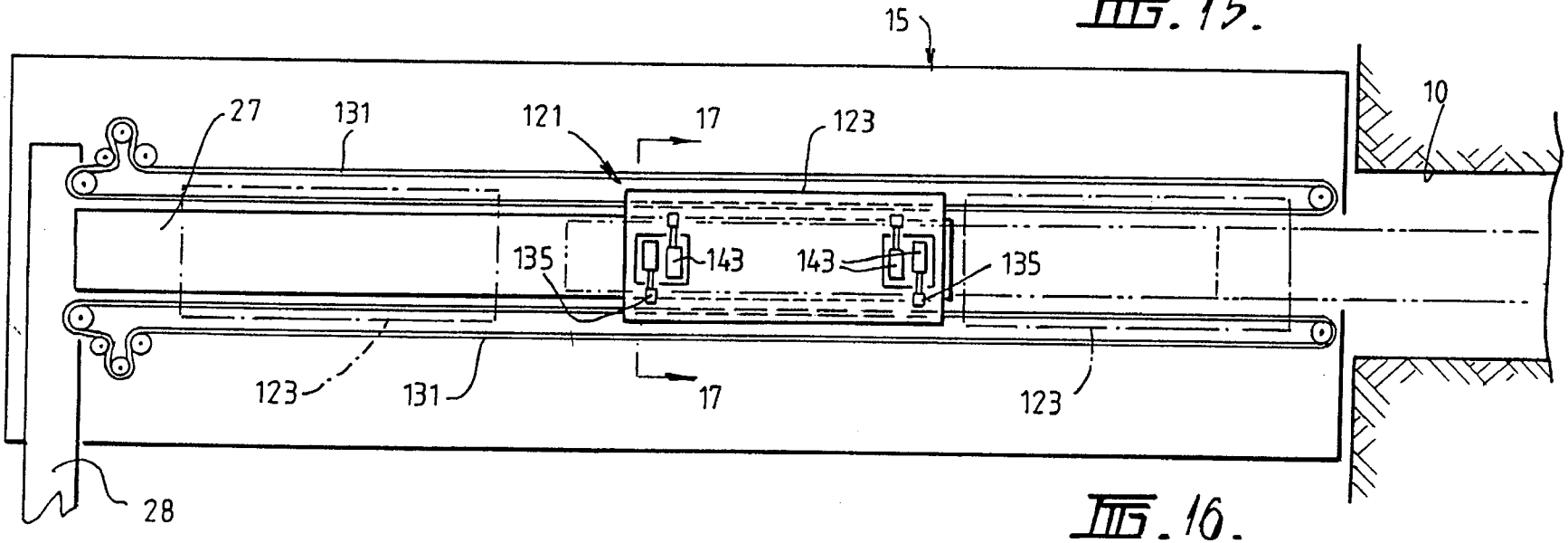
Figure 17:
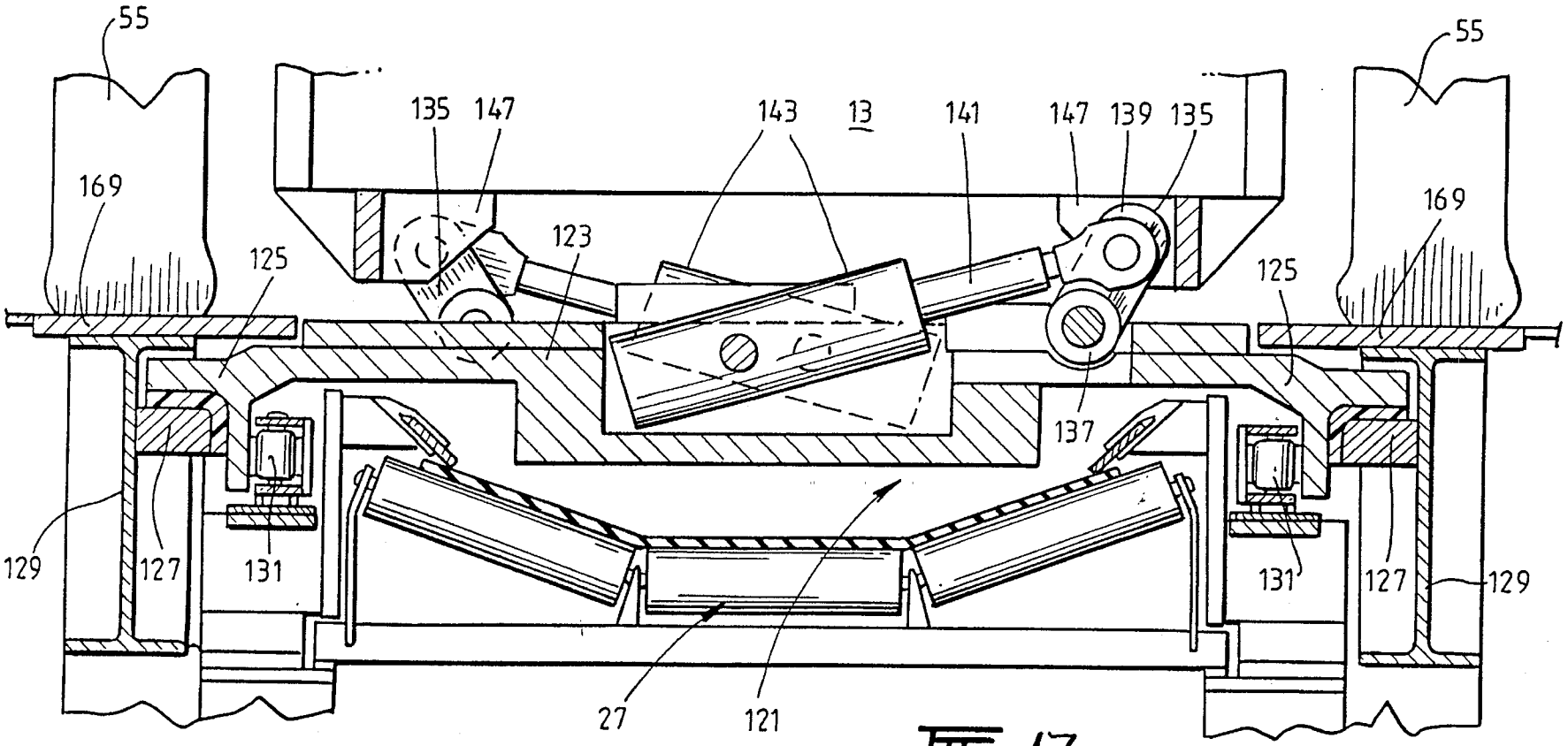
Figure 18:
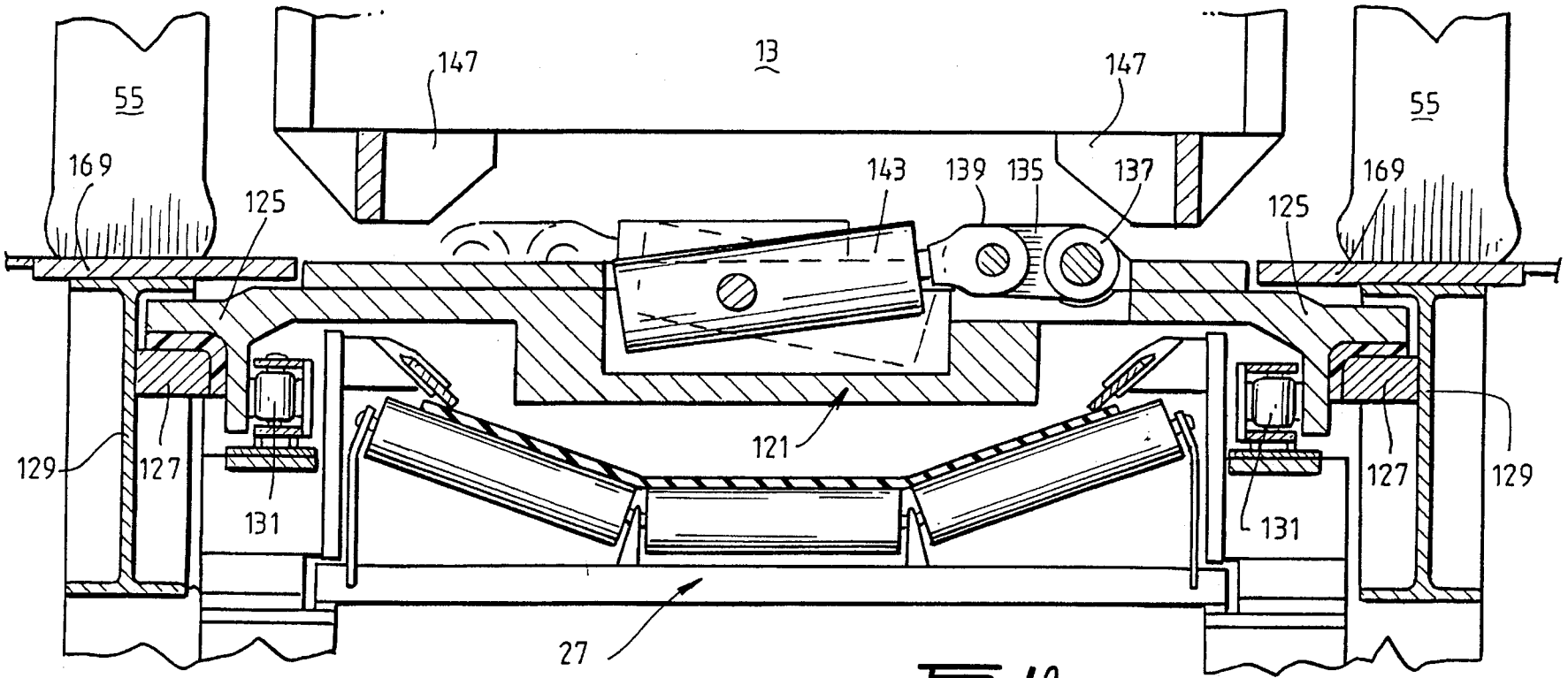
Figure 19:
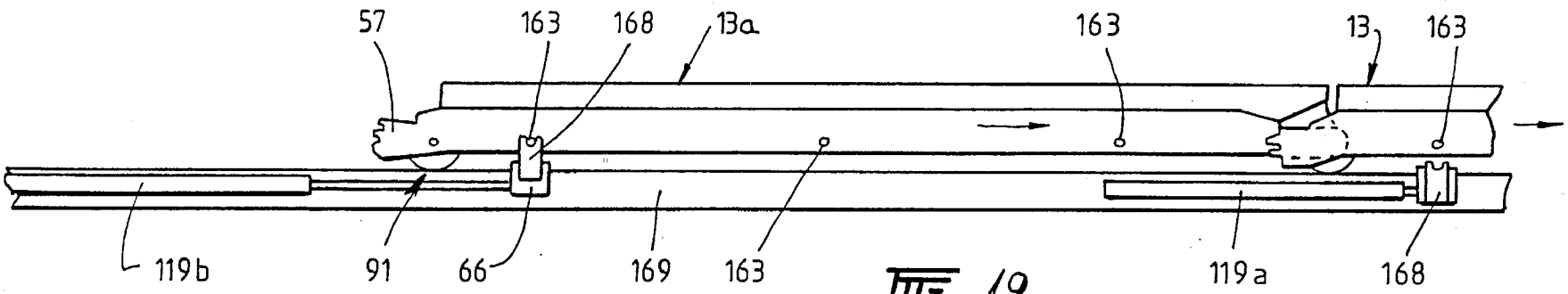
Figure 23:
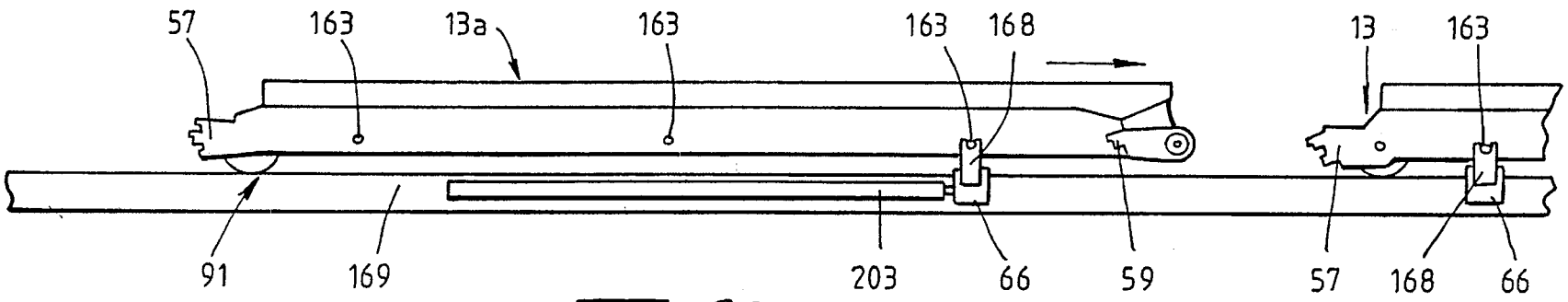
Figure 21:
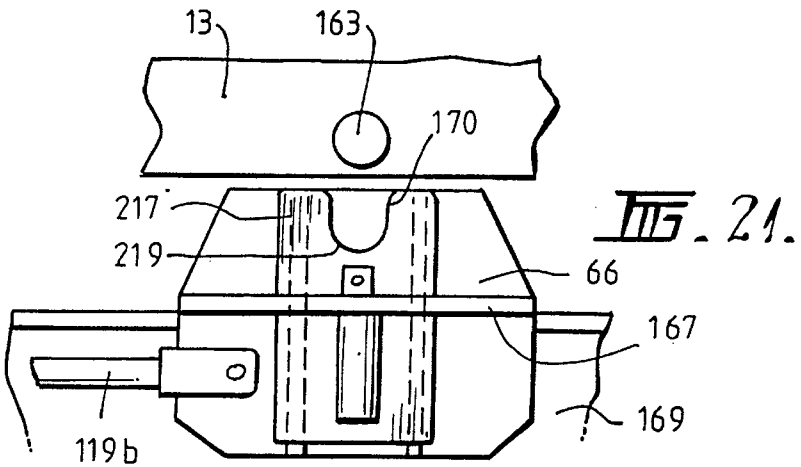
Figure 20:
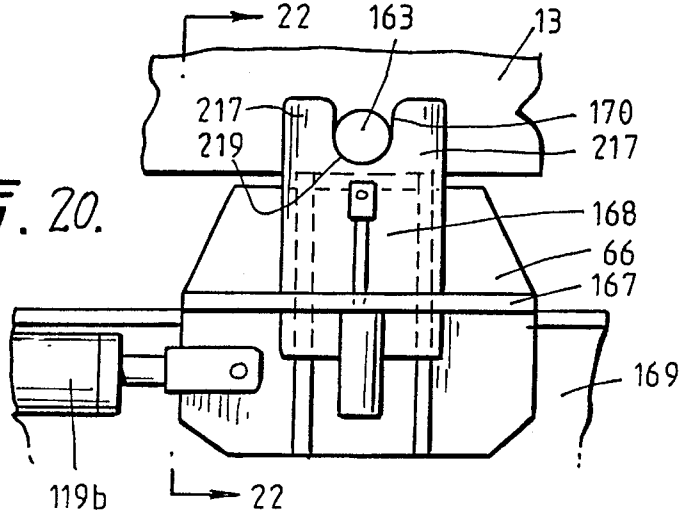
Figure 22:
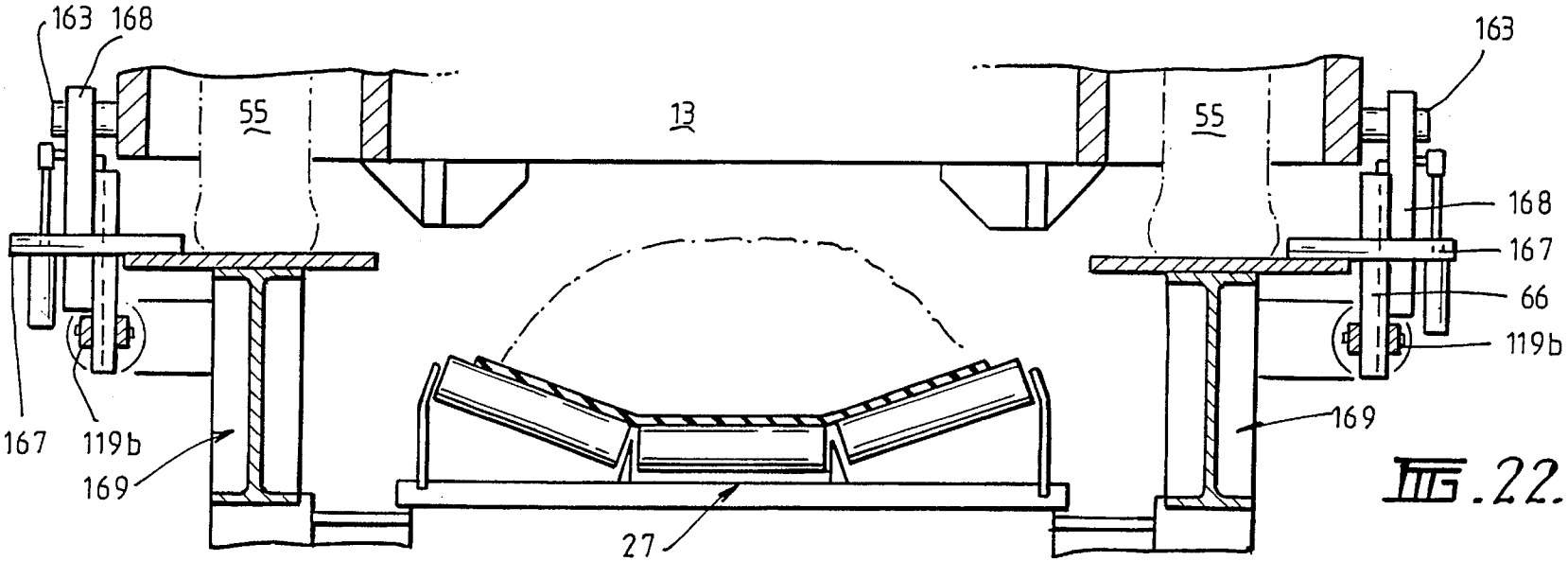
Figure 24:
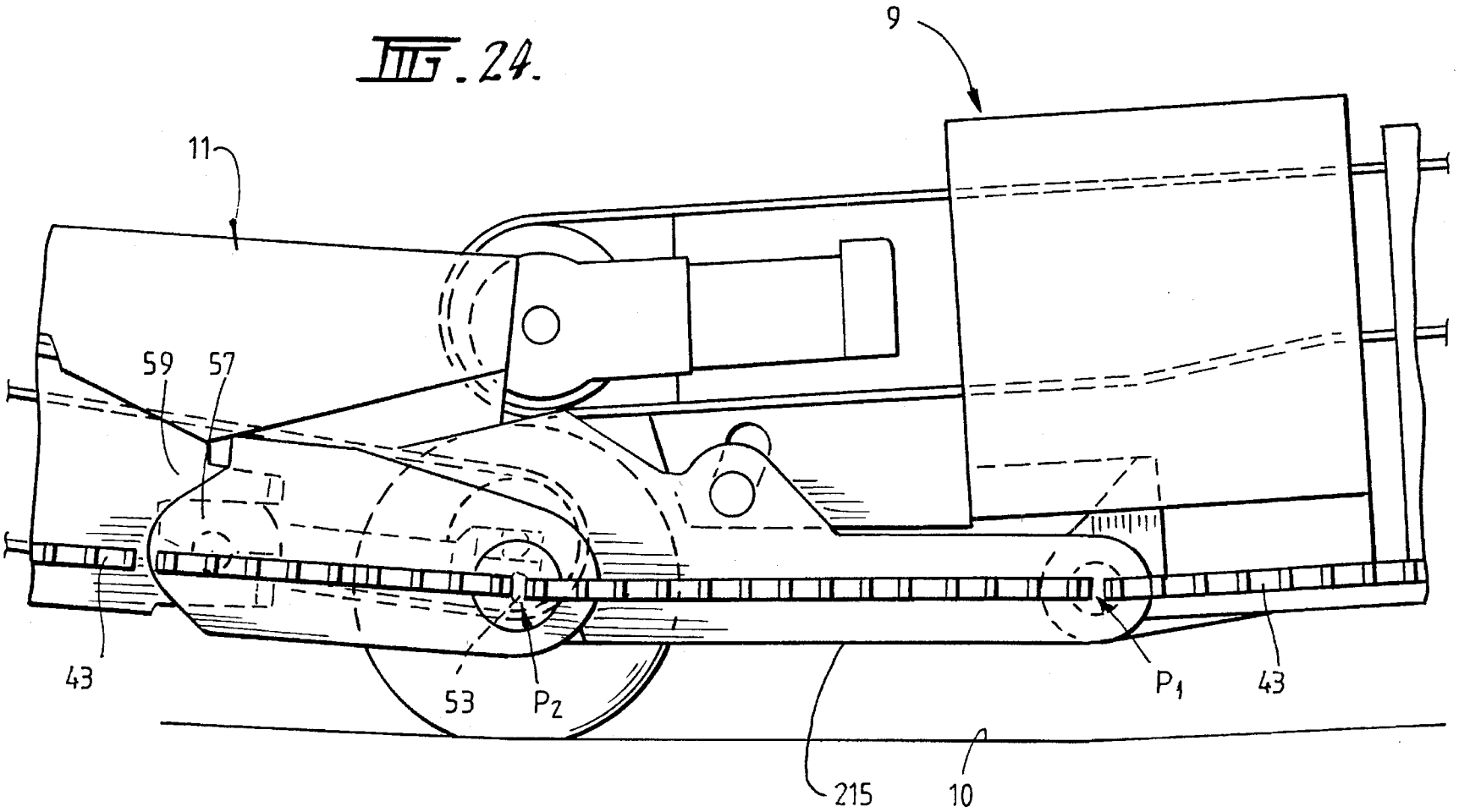
Figure 25:
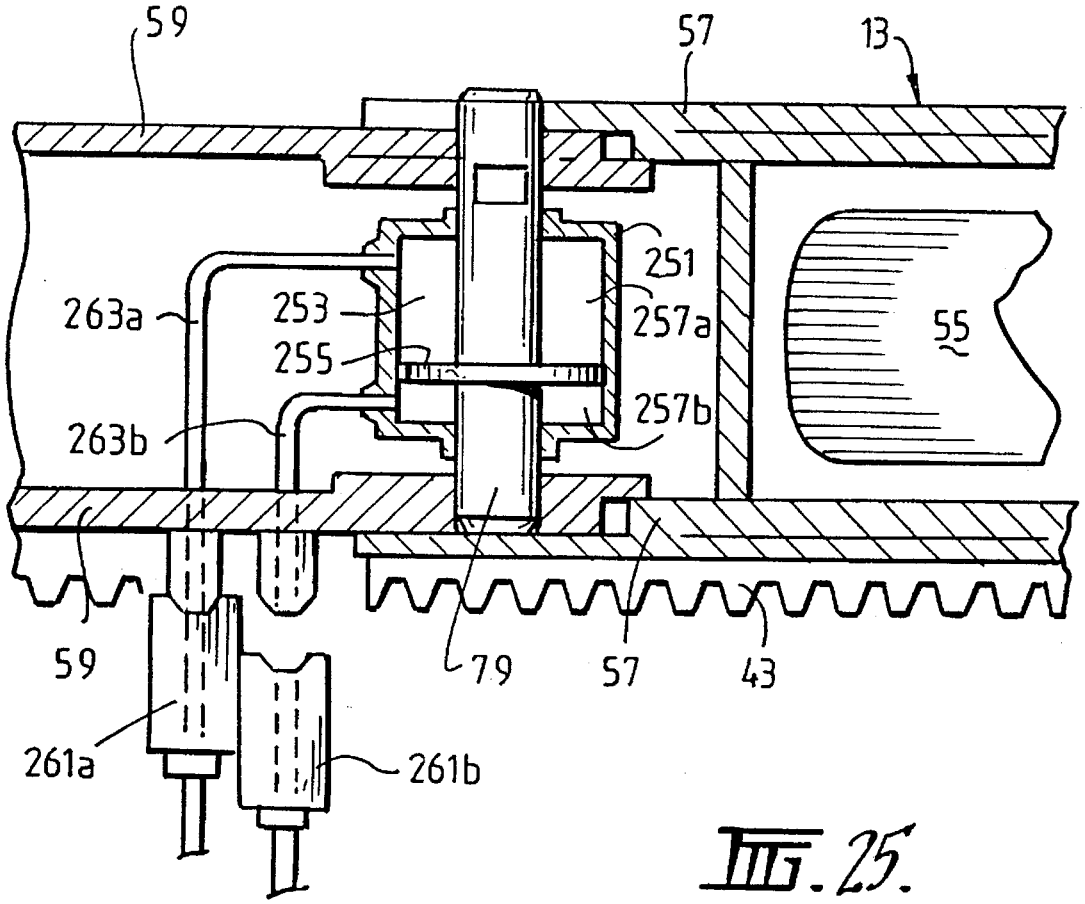

FIGS. 11 to 15 are a series of schematic side elevations which illustrate various stages in a sequence for adding a new conveyor unit to the rearward end of the rearward conveyor unit of the conveying means when the mining means and the conveying means of the highwall mining system are driven/controlled by a sliding plate assembly in addition to or alternatively to the rack and pinion system shown in FIGS. 2 to 6;

FIG. 16 is a section along the line 16—16 in FIG. 15;

FIG. 17 is a section along the line 17—17 in FIG. 16 with the contact arms of the sliding plate assembly in an operative position in which the contact arms engage lugs on the underside of the new conveyor unit and the mining means;

FIG. 18 is a section similar to that shown in FIG. 17 with the contact arms in a retracted position;

FIG. 19 is a schematic side elevation of the highwall mining system that is similar to the side elevations of FIGS. 11 to 15 which illustrate an alternative embodiment of a means for driving/controlling the movement of the mining means and the conveying means which is based on an assembly of tandem drive cylinders carrying locking plates for engaging the conveyor units;

FIG. 20 is a side elevation which illustrates in detail the locking plate on one of the tandem drive cylinders shown in FIG. 19 in the extended position with the locking plate engaging a lug extending from one side of a conveyor unit of the conveying means;

FIG. 21 is a side elevation similar to that shown in FIG. 20 with the locking plate in a retracted position;

FIG. 22 is a section along the line 22—22 in FIG. 20;

FIG. 23 is a schematic side elevation of the highwall mining system that is similar to the side elevation of FIG. 18 which illustrates an alternative embodiment of a means for driving/controlling the movement of the mining means and the conveying means;

FIG. 24 is a side elevation showing in detail the coupling means for coupling together the forward conveyor unit of the conveying means and the mining means; and FIG. 25 is a top plan view, in diagrammatic form, which illustrates in detail the coupling means shown on the right-hand side of FIGS. 7 and 8, respectively, modified to include an alternative embodiment of a means for moving the locking pin.

Figure 1:
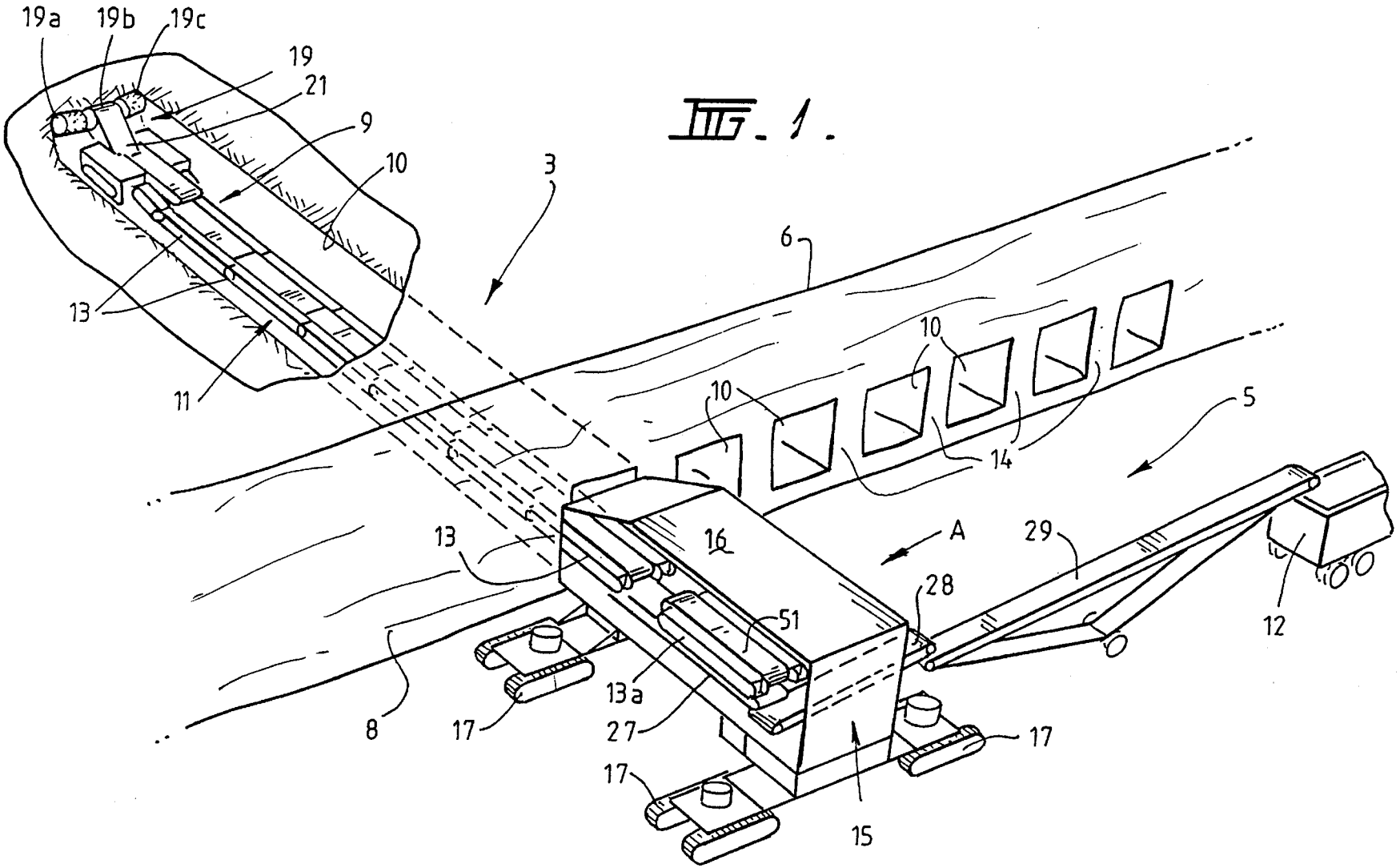
FIG. 1 is a perspective view, largely in schematic form, of the mining means, the conveying means, and the launch platform (with substantial detail omitted) of a preferred embodiment of a highwall mining system in accordance with the present invention located in an open-cut mine.

With reference to FIG. 1, the highwall mining system, generally identified by the numeral 3, is positioned in an open cut mine 5 to cut coal from a coal seam 8 extending from the exposed face of the highwall 6 of the mine 5.

The basic components of the highwall mining system 3 are:

(a) a mining means 9 for cutting coal from the seam 8 to form a drive 10 in the seam 8;

(b) a conveying means 11 formed from a plurality of conveyor units 13 releasably coupled together for conveying coal from the drive 10;

(c) a launch platform 15 located at the entrance to the drive 10 for adding new conveyor units 13 to the conveying means 11 and for discharging coal from the drive 10 into a surge bin or truck 12 for transportation from the mine 5; and (d) a combined driving/controlling means (not shown in FIG. 1) located on the launch platform 15 for driving the mining means 9 and the conveying means 13 into the seam 8 and thereafter for withdrawing the mining means 9 and the conveying means 11 from the drive 10 in a controlled manner without there being any uncontrolled movement of the mining means 9 and the conveying means 11 in response to the incline of the seam and/or during the addition of a new conveyor unit 13*a* to the conveying means 11.

The launch platform 15 is mounted on an assembly of caterpillar tracks 17 and is movable along the exposed face of the highwall 6 so that the highwall mining system 3 can form a plurality of drives 10 in the seam 8 which are separated by support pillars 14 of unmined material.

The mining means 9 comprises a track-mounted continuous miner having a plurality of cutting picks (not shown) on a rotatable cutting drum 19 (which comprises 3 separate segments 19*a*, 19*b*, 19*c*) mounted on the end of a boom 21 that is supported for pivotal movement about a horizontal axis. The mining means 9 is electrically powered from the launch platform 15 by means of an electrical cable 25 wound onto a reel 101 (FIG. 2).

Figure 2:
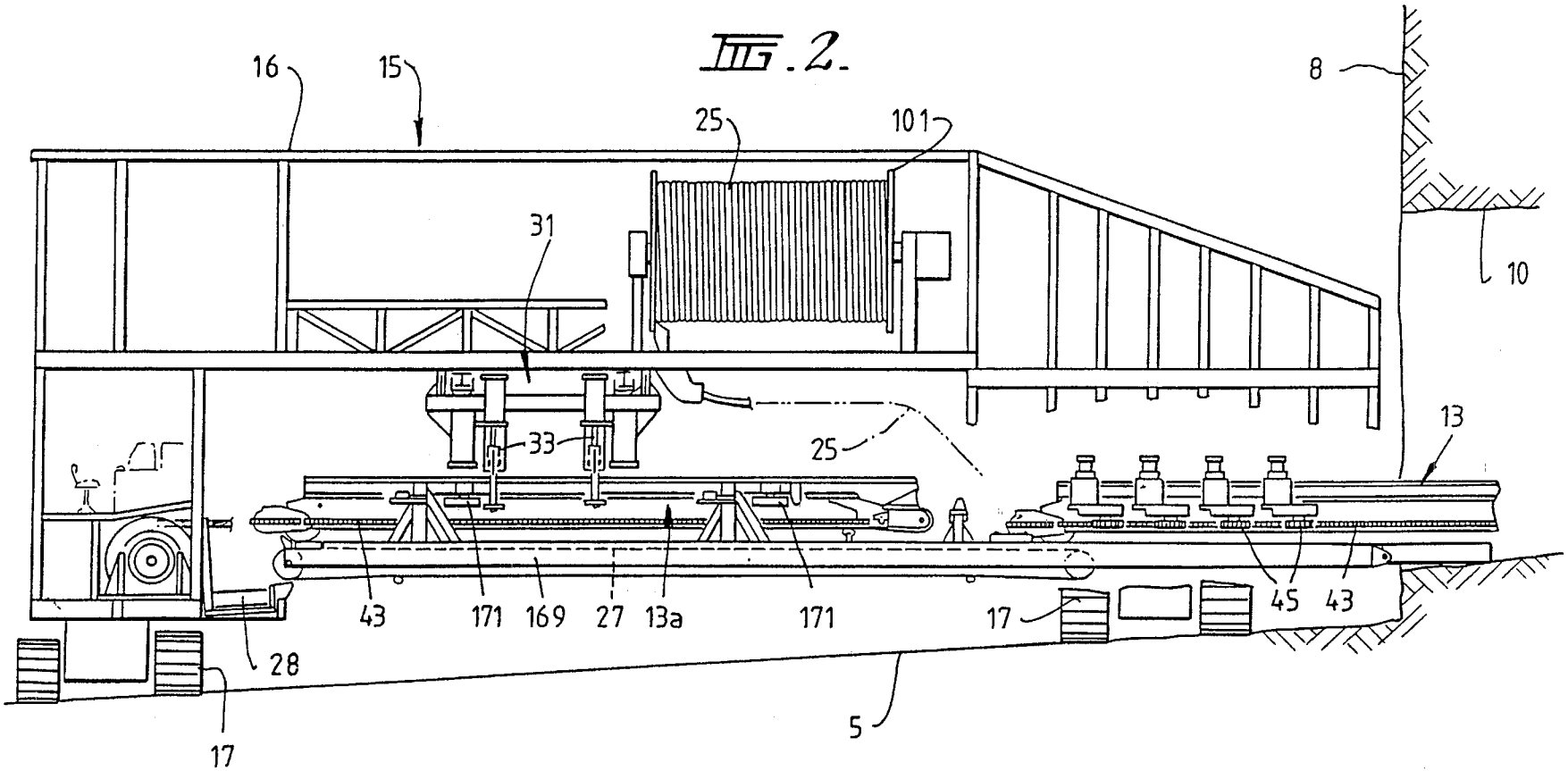
FIG. 2 is a side elevation of the launch platform of the highwall mining system as viewed in the direction of the arrow A in FIG. 1.

With reference to FIGS. 1 and 2, the launch platform 15 comprises a rigid support frame which includes an overhead continuous shield 16 as a safety measure for operators working on the launch platform 15.

Figure 3:
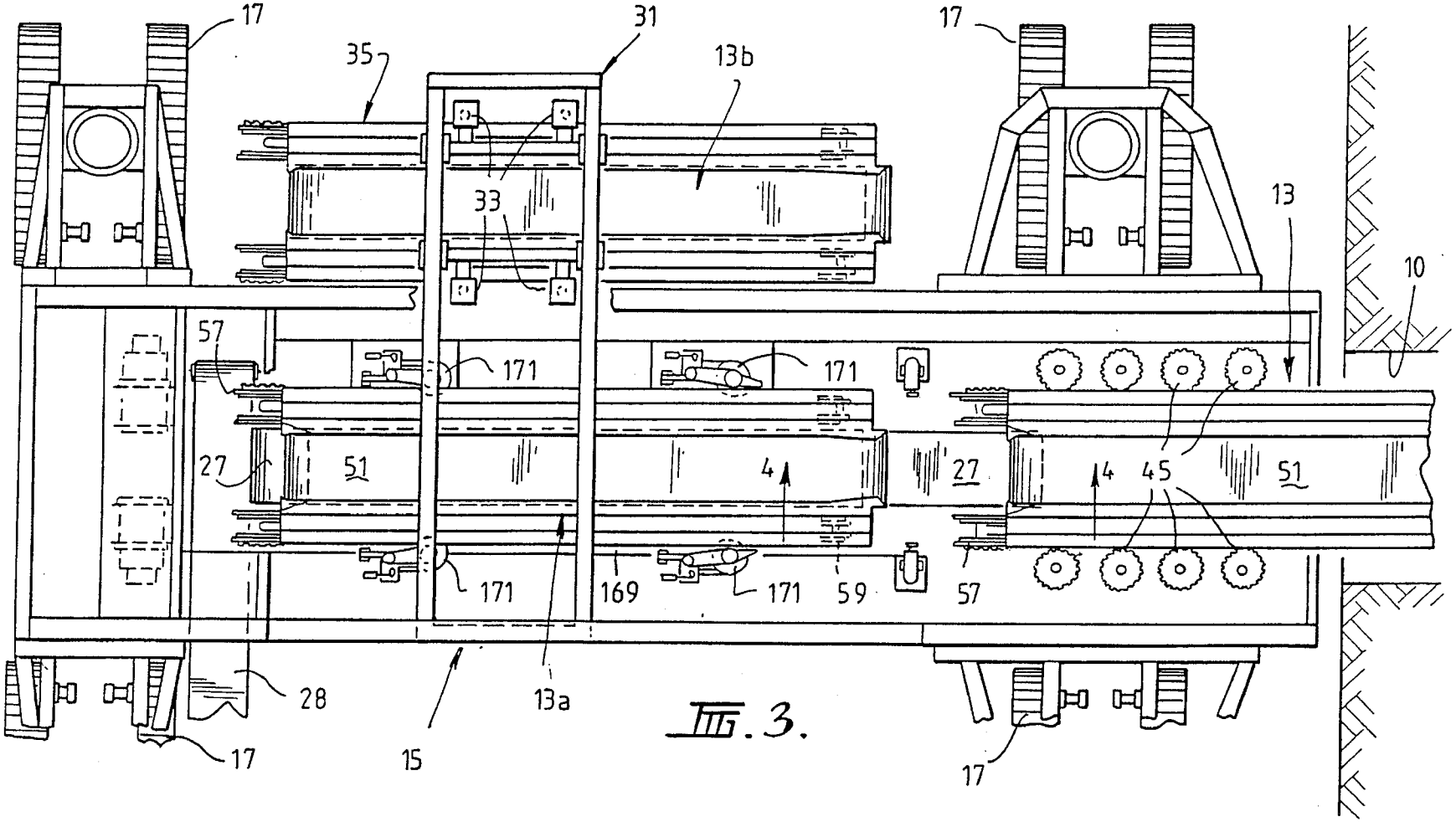
FIG. 3 is a top plan view of the launch platform shown in FIG. 2 with the upper section of the launch platform removed.

With particular reference to FIGS. 2 and 3, the launch platform 15 comprises, a receiving conveyor 27 (generally known as a "belly conveyor") for receiving coal discharged from the rearmost conveyor unit 13 of the conveying means 11.

With reference to FIGS. 1 to 3, the launch platform 15 further comprises a side discharge conveyor 28 for receiving coal from the receiving conveyor 27 and discharging the coal onto a truck loading conveyor 29 and into the surge bin or truck 12 (FIG. 1).

The dimensions on the launch platform 15 are selected so that there is sufficient space for a new conveyor unit 13*a* to be positioned on the launch platform 15 as shown in FIGS. 1 to 3 and moved into engagement with the rearmost conveyor unit 13 of the conveying means 11 as the mining means 9 and the conveying means 11 move forwardly into the drive.

The conveyor unit addition assembly of the launch platform 15 comprises an overhead crane 31 having a hoist assembly 33 for supporting a new conveyor unit 13*a* and for moving the new conveyor unit 13*a* from a loading station 35 on one side of the launch platform 15 to a conveyor unit addition position. When located at the conveyor unit addition position, the new conveyor unit 13*a* is positioned on a guide track 169 for the mining means 9 and the conveying means 11 and is aligned with the rearmost conveyor unit 13 of the conveying means 11.

The conveyor unit addition assembly further comprises pinch rollers 171 (FIGS. 2 and 3) which are pivotally mounted to move to positions on the sides of the guide track 169 to contact the new conveyor unit 13*a* and to align, guide, control and drive the new conveyor unit 13*a* towards the rearmost conveyor unit 13 of the conveying means 11.

With reference to FIGS. 2 to 6, one preferred embodiment of the combined driving/controlling means comprises a rack and pinion drive system for driving the mining means 9 and the conveying means 11 into the seam 8 and from the drive 10 thus formed in the seam 8.

The rack and pinion drive system comprises, rack bars 43 mounted on each side of the mining means 9 and the conveyor units 13, and 8 hydraulically powered drive pinions 45 mounted on the launch platform 15 and arranged to engage the rack bars 43 and thereby to drive the mining means 9 and the conveying means 11.

With particular reference to FIG. 3, the drive pinions 45 are arranged in 2 parallel lines with 4 drive pinions 45 in each line so that there are 4 drive pinions 45 on one side and 4 drive pinions 45 on the other side of the mining means 9 and the conveying means 11.

A feature of the rack and pinion drive system is that it provides drive to the mining means 9 and the conveying means 11 at a number of points along each side of the path of movement of the mining means 9 and the conveying means 11.

Another feature of the rack and pinion drive system is that it does not interfere with the conveyor unit addition assembly, and therefore a new conveyor unit 13*a* can be added to the conveying means 11 without disconnecting the drive to the mining means 9 and the conveying means 11. This is particularly important when the highwall mining system operates in "dipping" seams to avoid the risk that the conveying means 11 may apply excessive force onto the back of and thereby jam or damage the mining means 9.

It can also readily be appreciated that in addition, in more general terms, the rack and pinion system drives the mining means 9 and the conveying means 11 in a controlled manner and prevents any uncontrolled forward and/or rearward movement. In these circumstances, the rack and pinion system is a combined driving and controlling means.

In situations where it is required that the mining means 9 and the conveying means 11 be held stationary it is the rack and pinion drive system, and more particularly the hydraulic motors (not shown), that hold the mining means 9 and the conveying means 11 in position.

It is also preferred that the rack and pinion drive system further comprises friction or other brakes (not shown) to provide emergency braking should there be a failure of the hydraulic motors of the drive pinions 45. In this context it is noted that, by providing 8 drive pinions 45, the rack and pinion drive system has a high level of redundancy if there is a failure of one or more drive pinions 45.

It is also preferred that the mining means 9 and the conveyor units 13 comprise friction or other brakes (not shown) to provide additional emergency braking, if required, in the event of a failure of the hydraulic motors of the drive pinions 45.

With reference to FIGS. 11 to 18, another preferred embodiment of the combined driving/controlling means comprises a sliding plate assembly on the launch platform 15. The sliding plate assembly can be used in place of or in conjunction with the rack and pinion system and, as is the case with the rack and pinion system, allows only controlled movement of the mining means 9 and the conveying means 11.

With particular reference to FIGS. 16 to 18, the sliding plate assembly comprises a plate member 123 which is positioned for sliding movement above the belly conveyor 27 and below the conveyor units 13 on the launch platform 15. The plate member 123 comprises L-shaped guide surfaces 125 which bear against and are thereby supported by guide rails 127 that are welded to I-beams 129. The I-beams 129 form part of the rigid support frame of the launch vehicle 15 and, as shown in the figures, support and are parallel to the guide track 169 for the mining means 9 and the conveying means 11. As will be apparent from FIGS. 16 to 18, the guide rails 127 support the plate member 123 for sliding movement in the direction of movement of the mining means 9 and the conveying means 11.

the plate member 123 comprises a means to engage a conveyor unit 13. The engaging means comprises 4 contact arms 135. Each contact arm 135 is pivotally mounted at one end 137 to the plate member 123 and at the other end 139 to the free end of a piston arm 141 of a piston/cylinder assembly 143. The piston/cylinder assembly 143 is also pivotally connected to the plate member 123. The arrangement is such that extension or retraction of the piston arm 141 causes the contact arm 139 to swing about the end 137 and such movement, assuming the appropriate positioning of a conveyor unit 13 as shown in FIG. 17, moves the contact arm 135 into line with a lug 147 which depends downwardly from the underside of the conveyor unit 13. As a consequence, when in this operative position, sliding movement of the plate member 123 causes the contact arm 135 to bear against the lug 147.

The sliding plate assembly 121 further comprises a drive assembly for sliding the plate member 123. The drive assembly comprises a continuous chain drive 131. connected to each side of the plate member 123.

The operation of the sliding plate assembly is described hereinafter with reference to FIGS. 11 to 15 in the context of the addition of a new conveyor unit **13*a* to the rearward end of the last conveyor unit 13 of the conveying means 11** and in the context that the sliding plate assembly is used in conjunction with the rack and pinion system.

In each of FIGS. 11 to 15, the mining means (not shown) and the conveying means 11 are moving towards the right-hand side of the figure into a drive 10 and coal is being transferred from the drive 10 along the conveyor units 13 of the conveying means 11.

Figure 11:
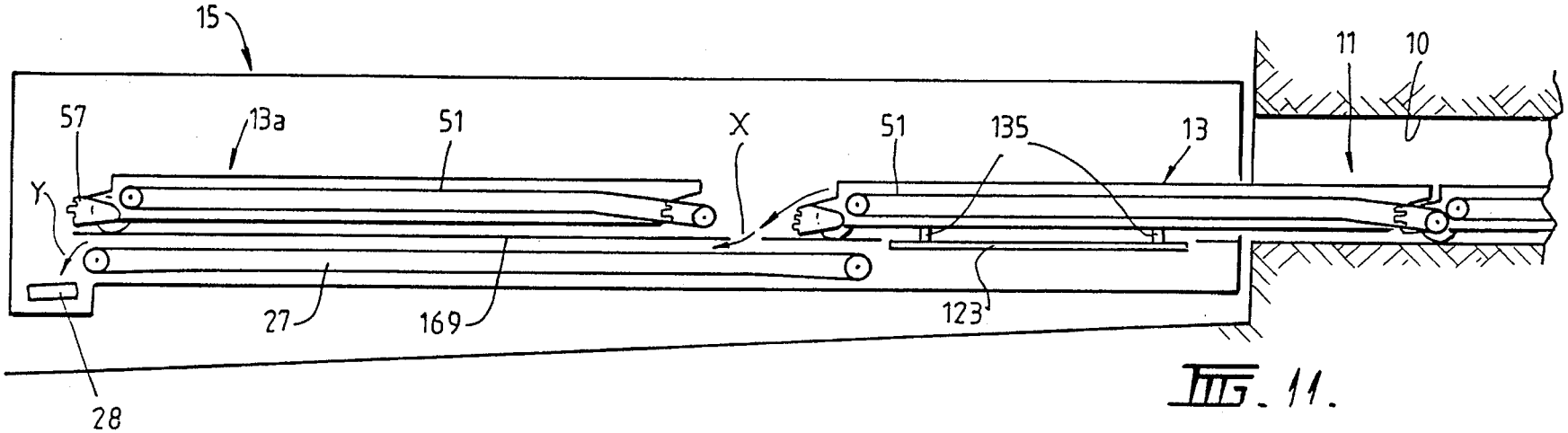

With reference to FIG. 11 the arrows identified by the arrow X indicate the flow of coal from the last conveyor unit 13 of the conveying means 11 onto the belly conveyor 27. The coal is thereafter moved by the belly conveyor 27 towards the left of the figure and is discharged at the location identified by the arrow Y onto the discharge conveyor 28. The figure also shows a new conveyor unit **13*a* in a position ready to be added to the conveying means 11**.

In FIG. 11, the plate member 123 is positioned with the contact arm 135 in an operative position engaging the rearmost conveyor unit 13 of the conveying means 11. In this position, the sliding plate assembly and the rack and pinion system operate together to move the mining means 9 and the conveying means 11 forward in a controlled manner.

Figure 12:
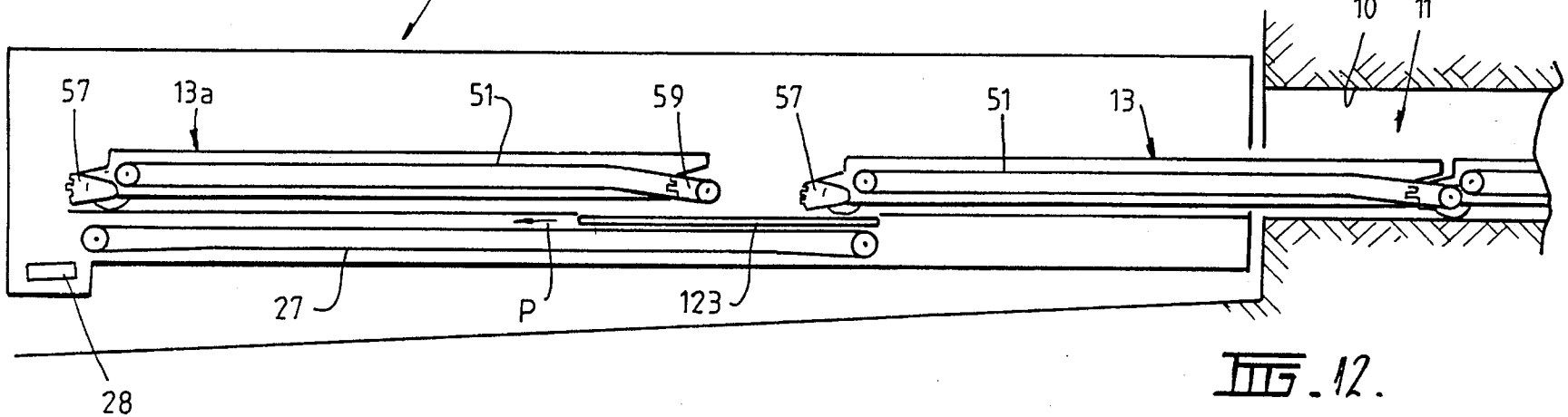

In order to add the new conveyor unit 13 shown in the figures to the rearmost conveyor unit 13 of the conveying means 11 the plate member 123 is disengaged from the rearmost conveyor unit 13 by moving the contact arms 135 to the inoperative position shown in FIG. 18 and thereafter moving the plate member 123 to the left of FIG. 12 as indicated by the arrow P in FIG. 12.

It is noted that during this process, the mining means 9 and the conveying means 11 are held in a controlled and secure manner by means of the rack and pinion system. In this connection, the arrangement is such that the rack and pinion system may be holding the mining means 9 and the conveying means 11 stationary or driving the assembly forward into the seam 8.

In addition, it is noted that the plate member 123 is an obstruction to the flow of coal from the rearmost conveyor unit 13 of the conveying means 11 into the belly conveyor 27 and therefore during the recycling step shown in FIG. 12 it is necessary that there be no coal being discharged from the rearmost conveyor unit 13 of the conveying means 11.

Figure 13:
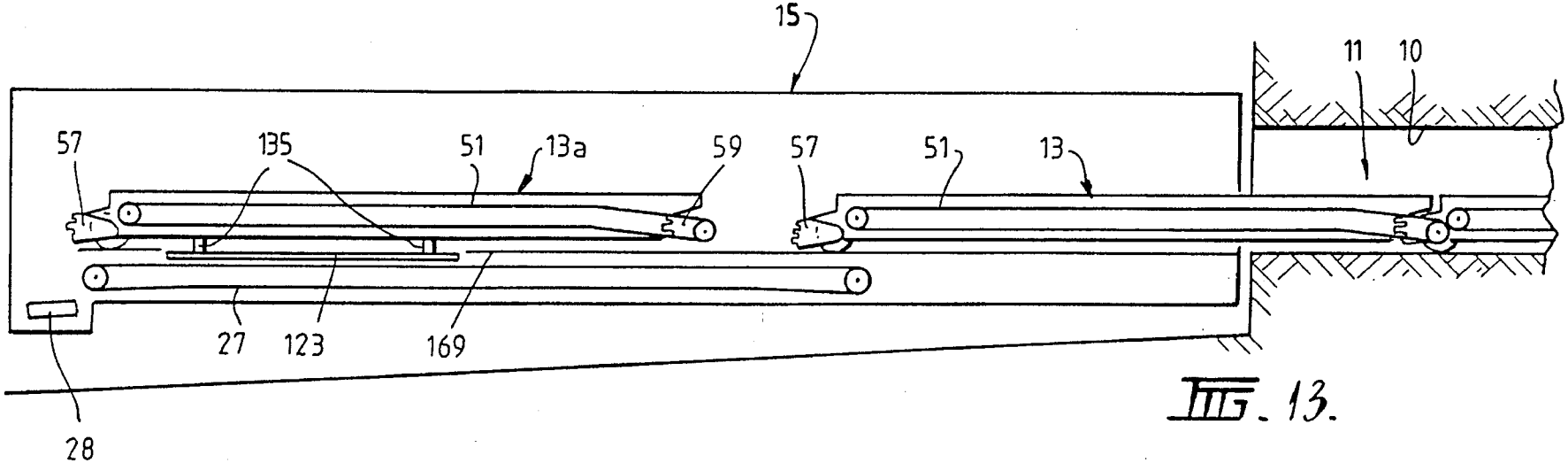
Figure 14:
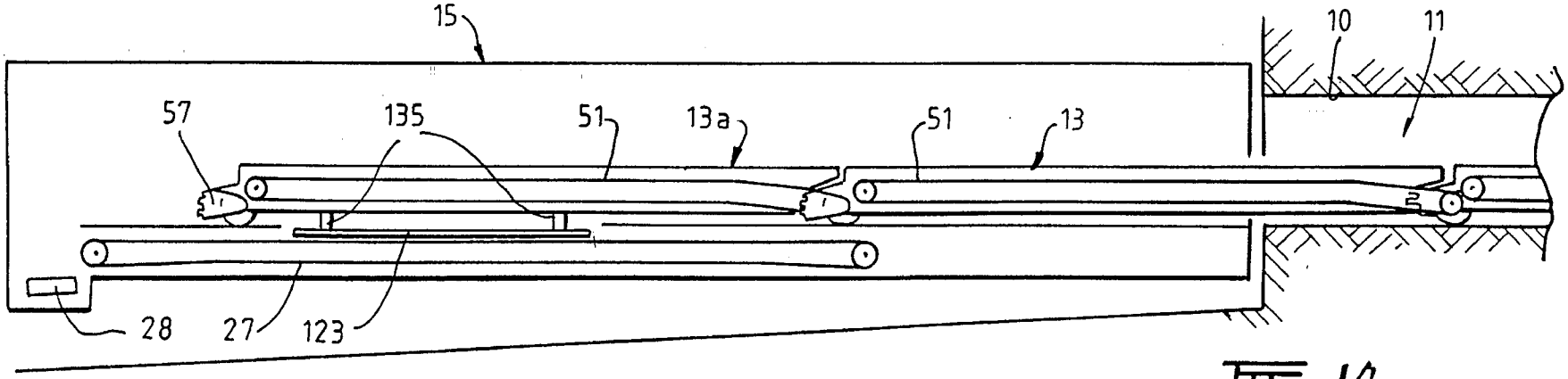

The purpose of the recycling step shown in FIG. 12 is to reposition the plate member 123 underneath the new conveyor unit **13*a* and, as is shown in FIGS. 13 and 14, thereafter to engage the new conveyor unit 13 via the contact arms 135 and to move the new conveyor unit 13*a* forward to be coupled to the rearmost unit 13 of the conveying means 11. At that point, the sliding plate assembly and the rack and pinion drive system operate again in conjunction to move the mining means 9 and the now lengthened conveying means 11 into the drive 10**.

With reference to FIG. 15, the final step in the procedure involves operation of the conveyor unit addition assembly described previously to position another new conveyor unit **13*b***.

With reference to FIGS. 19 to 22, another preferred embodiment of the combined driving/controlling means comprises a forward set and a rearward set of tandem drive cylinders on the launch platform 15, with one drive cylinder of each set on each side of the guide track 169 of the launch platform 15.

The side elevation of FIG. 19 illustrates one of the drive cylinder **119*a* of the forward set and one of the drive cylinders 119*b* of the rearward set. It can readily be appreciated that there are correspondingly positioned drive cylinders 119*a*, 119*b* on the other side of the conveying means 11 on the launch platform 15**.

The driving/controlling means further comprises a means for engaging pins 163 extending from the sides of the conveyor units 11. The engaging means is connected to the forward end of the piston of each drive cylinder **119*a*, 119*b* and includes a support frame 66 having a flange 167 which is arranged for sliding contact on the guide track 169 for the mining means and the conveying means 11 in response to actuation of the respective drive cylinder 119*a*, 119*b*. The engaging means further comprises a locking plate 168 having a cut-out section 170 for receiving and engaging a pin 163 of a conveyor unit 13. The cut-out section 170 is formed in the upper end of the locking plate 168 and is defined by sides 217 and a base 219. The locking plate 168 is supported by the support frame 66 to be vertically movable between a retracted position as shown in FIG. 21 in which the locking plate 168 is clear of the pin 163 and a locked position as shown in FIGS. 19, 20, 22 in which the locking plate 168 engages the pin 163 of a conveyor unit 13. It can readily be appreciated that the locking plate 168 and, in particular, the construction of the cut-out section 170 with the sides 217, prevents uncontrolled forward and/or rearward movement of the conveyor unit 13**.

In use, the two sets of drive cylinders 119*a*, 119*b* act co-operatively as a "walking" system to advance by pushing and to withdraw by pulling the mining means 9 and the conveying means 11. With such an arrangement, during advance into the seam 8, the two sets of drive cylinders 119*a*, 119*b* act cyclically so that one set retracts while the other set controls the advance rate of the mining means 9 and the conveying means 11.

With reference to FIG. 23, another preferred embodiment of the combined driving/controlling means is similar to that shown in FIGS. 19 to 22 and comprises:

(a) a single set of drive cylinders 203, with one drive cylinder 203 on each side of the guide track 169 for the mining means 9 and the conveying means 11;

(b) the engaging means shown in FIGS. 19 to 22 connected to the drive cylinders 203; and (c) an additional engaging means of the type shown in FIGS. 19 to 22 but modified so as to be fixed to the guide track 169.

With such an arrangement, the engaging means is operable when the drive cylinders 203 reach the limit of their forward travel to engage and hold pins 163 on a conveyor unit 13 of the conveying means 9 while the drive cylinders 203 are recycled to engage and move forward a rear conveyor unit 13*a* and thereafter move forward the mining means 9 and the now-lengthened conveying means 11.

With reference to the figures generally, and in particular FIG. 3, each conveyor unit 13 comprises a belt or a chain conveyor 51 which extends between the forward and the rearward ends of the conveyor unit 13 and is operable to receive coal from an immediately upstream conveyor unit 13 and to deliver the coal to an immediately downstream conveyor unit 13.

Each conveyor unit 13 further comprises a single wheel assembly 91 located towards one end of the conveyor unit 13. As can best be seen in FIGS. 4 and 5, the wheel assembly 91 comprises an axle 53 which supports a pair of wheels 55.

Each conveyor unit 13 further comprises a coupling means for mechanically coupling the conveyor unit 13 to a forward and/or rearward conveyor unit 13 and/or to the mining means 9.

With reference to FIGS. 3 to 8, a preferred embodiment of the coupling means comprises a pair of male members 57 on each side at one end of each conveyor unit 13 and a pair of female members 59 on each side at the other end of each conveyor unit 13.

The pairs of male and female members 57, 59 are arranged so that when a new conveyor unit 13 is moved towards the rearmost conveyor unit 13*a* of the conveying means 11 the male members 57 are received in the female members 59 to couple together the conveyor units 13, 13*a*.

The male members 57 are mounted for limited pivotal movement, typically of the order of 8°, about the axle 53 of the wheel assembly 91 in order:

(a) to facilitate coupling of the male members 57 and the corresponding female members 59; and (b) to allow limited scope for the conveyor units 13 to follow undulations along the length of the drive.

The female members 59 are fixed to the conveyor units 13.

With further reference to FIGS. 4 to 8, each male member 57 comprises 3 co-planar prongs 61 which are separated by 2 cavities 63, and each female member 59 comprises 2 prongs 65 separated by a central cavity 67. The arrangement is such that:

(a) the central prong 61 of each male member 57 is adapted to be received in the central cavity 67 of a corresponding female member 59; and (b) simultaneously, the prongs 65 of each female member 59 are adapted to be received in the cavities 63 of the male member 57.

It can readily be appreciated that once the male members 57 are received in the female members 59 (and are locked in position as described hereinafter) the coupling formed does not allow relative rotation of the adjacent conveyor units 13 about a vertical axis.

The prongs 61, 65 and the cavities 63, 67 are tapered in order to assist alignment of the male and female members 57, 59 as a new conveyor unit 13*a* is moved towards the rearmost conveying unit 13 of the conveying means 11.

It is noted that the alignment of the male and female members 57, 59 is further assisted by the rack and pinion drive system.

Figure 4:
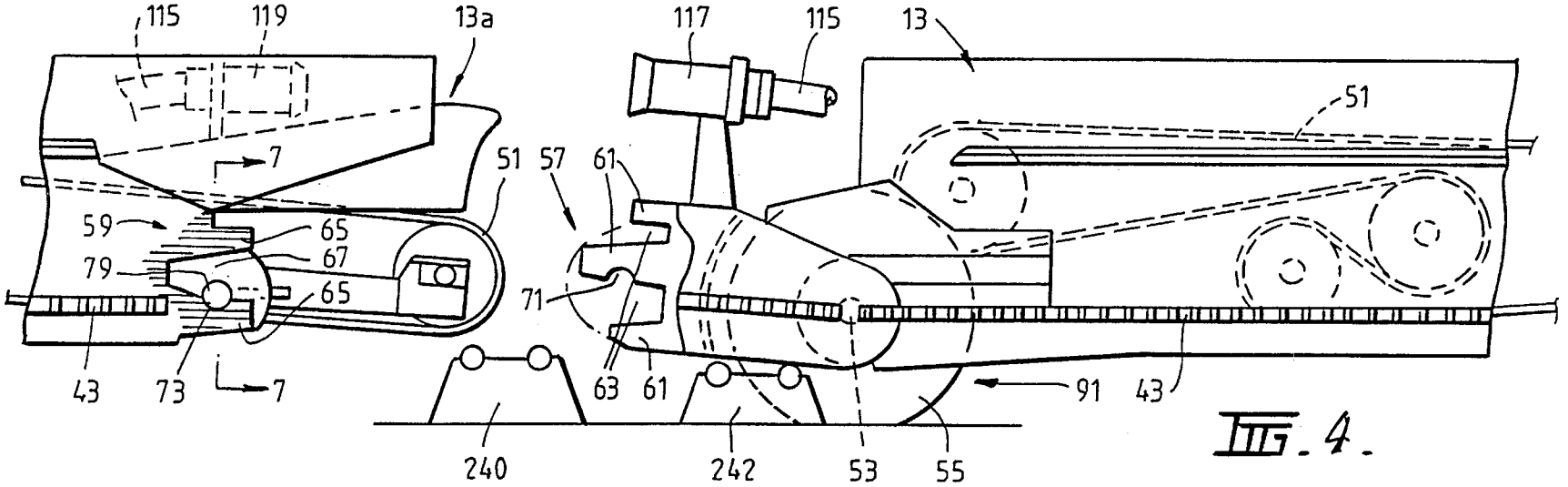
FIG. 4 is a section along the line 4—4 in FIG. 3 and shows in side elevation the forward end of a new conveyor unit to be added to the conveying means and the rearward end of the rearward conveyor unit of the conveying means prior to the new conveyor unit being added to the conveying means.
Figure 5:
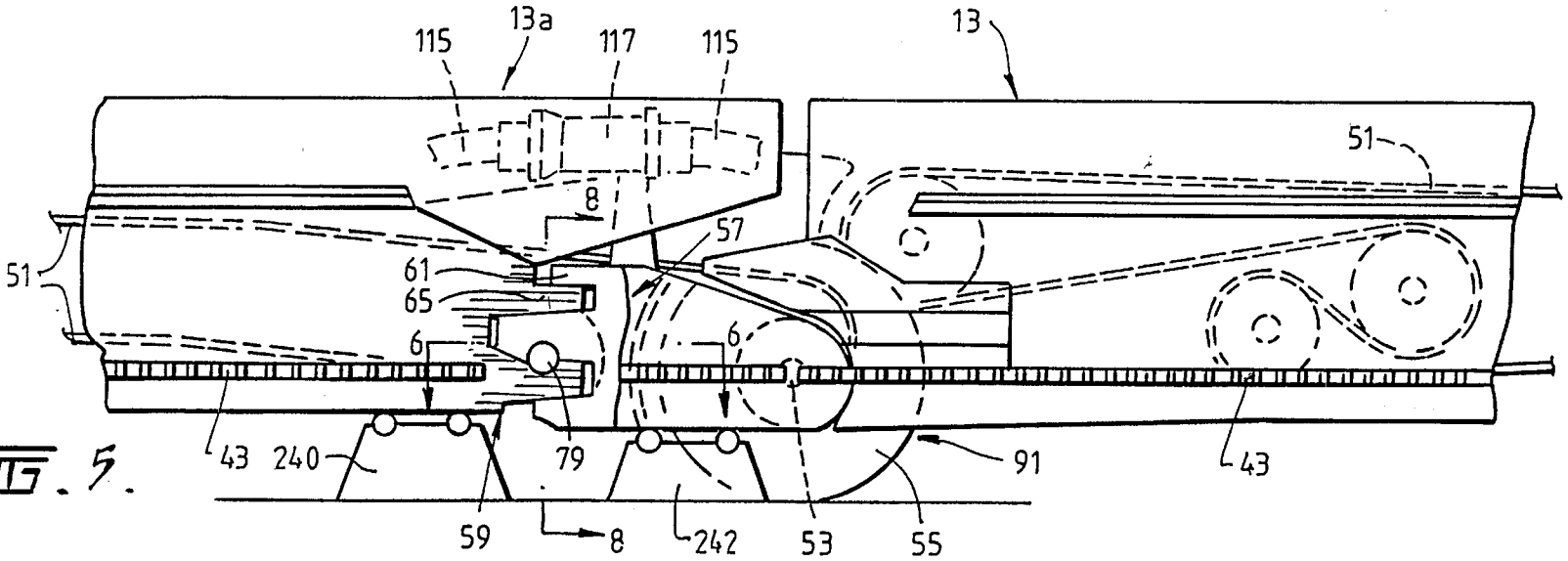
FIG. 5 is a side elevation similar to that shown in FIG. 4 but after the new conveyor unit has been added to the conveying means.

In addition, with reference to FIGS. 4 and 5, it is noted that the alignment of the male and female members 57, 59 is further assisted by roller assemblies 240, 242.

The lower edge of the central prong 61 of each male member 57 comprises a semi-circular cut-out section 71, and the upper edge of the lower prong 65 of each female member 59 comprises a semi-circular cut-out section 73. The arrangement of the cut-out sections 71, 73 is such that when the male members 57 are received in the female members 59 the cut-out sections 71, 73 form circular openings.

In an alternative arrangement the male and/or female members 57, 59 may comprise complete circular openings which are brought into alignment when the male members 57 are received in the female members 59.

The coupling means further comprises a locking pin 79 which is adapted to be positioned in the openings to lock together the male and female members 57, 59.

Figure 6:
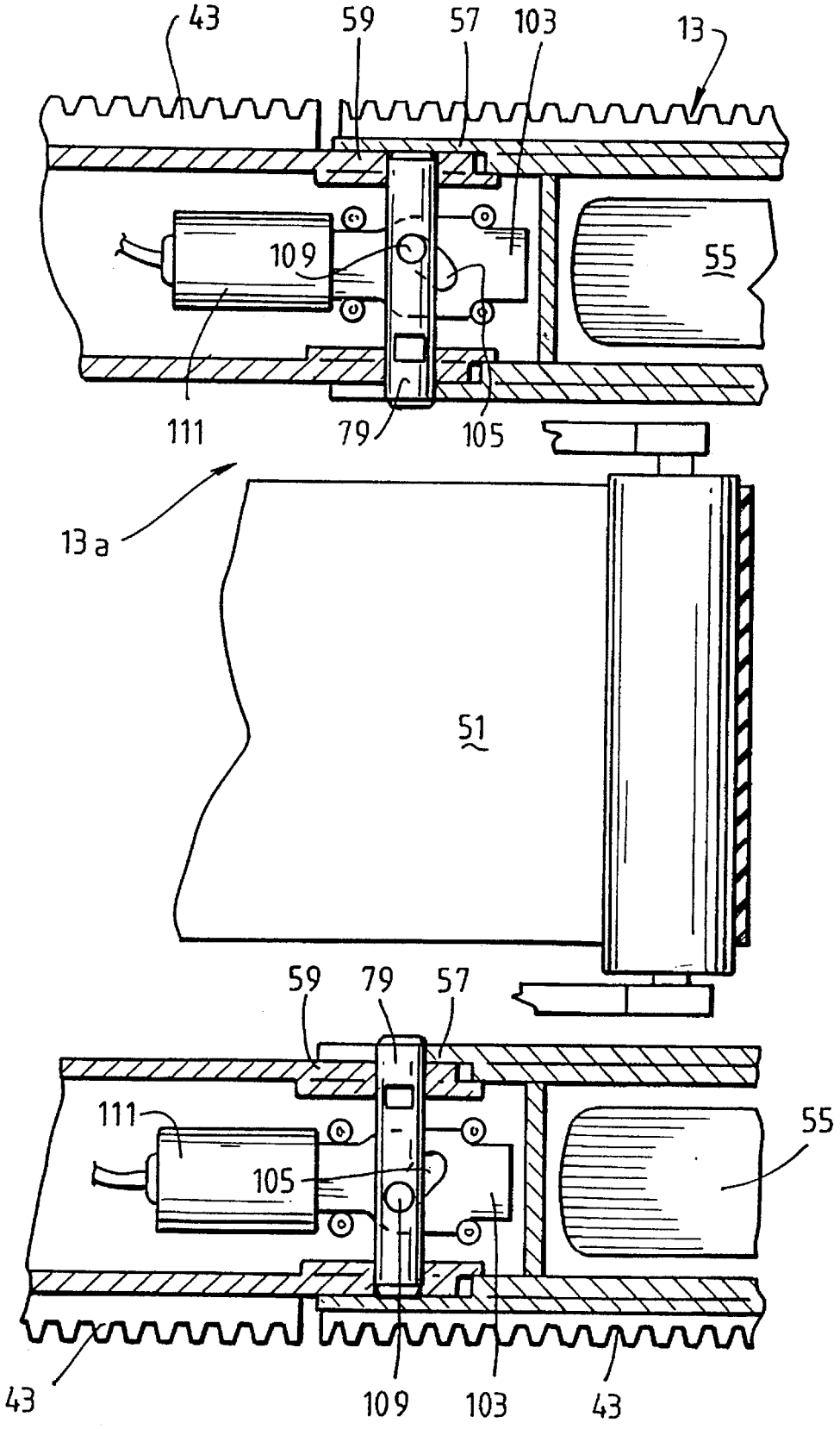
FIG. 6 is a section along the line 6—6 in FIG. 5.

The locking pin 79 is arranged for sliding movement between an unlocked position (FIG. 7) and a locked position (FIGS. 6 and 8). In the locked position the locking pin 79 extends into the openings formed by each pair of male and female members 57, 59. It can readily be appreciated that once the locking pins 79 are engaged the coupling allows substantially no relative translation of adjacent conveyor units 13.

With reference to FIG. 7, it is noted that, in the unlocked position, the locking pins 79 are clear of the openings formed by the male and female members 57, 59 on the outer sides of each pair of male and female members 57, 59 but are not clear of and extend into the openings formed by the male and female members 57, 59 on the inner sides of each pair of male and female members 57, 59. In this position, the locking pins 79 do not interfere with movement of the male and female members 57, 59 into a position in which the male members 57 are received in the female members 59 because each locking pin 79 comprises a cut-out section 81 which defines a gap to allow the central prongs 63 of the male member 57 to move relative to the corresponding female member 59.

With reference to FIGS. 6 to 8, the coupling means further comprises a means for moving each locking pin 79 between the unlocked and locked positions.

The locking pin moving means comprises a tongue 103 which is supported for movement in the direction of movement of the mining means 9 and the conveying means 11 and has a slot 105 at an angle, typically 45°, to the direction of movement of the conveying means 11. The locking pin 79 comprises a horizontal slot 107 and a vertical pin 109 which extends through the mid-point of the slot 107. The tongue 103 is positioned in the slot 107 with the vertical pin 109 extending through the slot 105. The locking pin 79 is retained so that it can only slide between the locked and unlocked positions. It can readily be appreciated that, with such an arrangement, movement of the tongue 103 in the direction of movement of the conveying means 11 (towards the right in FIG. 6) will cause the vertical pin 109 in the locking pin 79 to slide in the slot 105 and thereby move the locking pin 79 sideways into or from the locked and unlocked positions. The locking pin moving means further comprises a compressed gas assembly 111 for moving the tongue 103.

Figure 9:
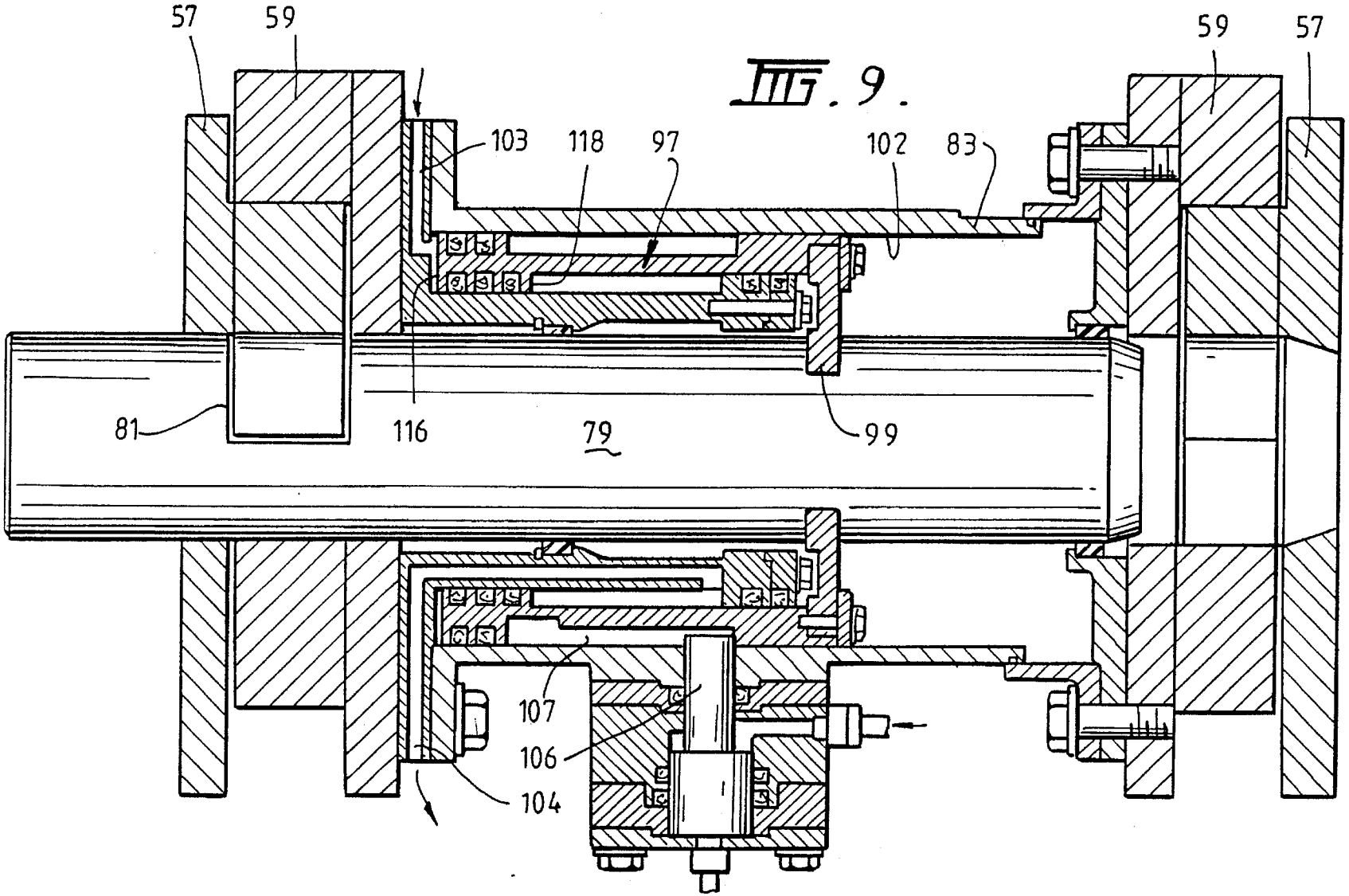
FIGS. 9 and 10 are sections which illustrate in detail the coupling means shown on the right-hand side of FIGS. 7 and 8, respectively, modified to include an alternative embodiment of a means for moving the locking pin between the unlocked position as shown in FIG. 9 and the locked position as shown in FIG. 10.
Figure 10:
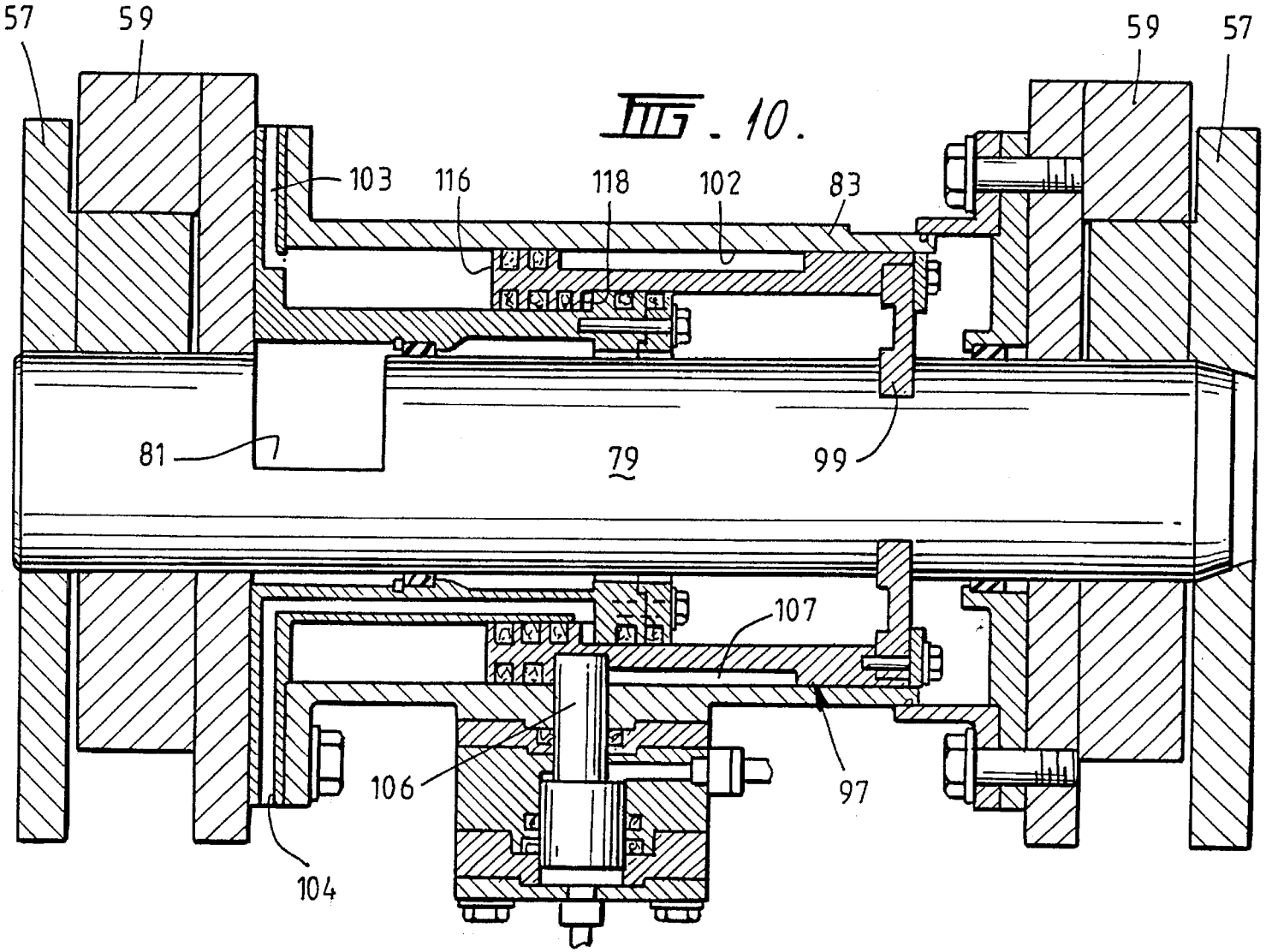

With reference to FIGS. 9 and 10, an alternative form of the locking pin moving means comprises a cylindrical housing 83 extending between and connected to the female members 59 of each pair of male and female members 57, 59 such that the associated locking pin 79 extends co-axially through the housing 83.

An annular sleeve assembly 97 is mounted via an annular face plate 99 to the locking pin 79 and is constructed so that the outer surfaces of the sleeve assembly 97 contact and can slide against the internal wall 102 of the housing 83. The sleeve assembly 97 includes annular surfaces 116 and 118.

The locking pin moving means further comprises sources of gas or hydraulic fluid (not shown) which are in separate fluid communication with the sleeve assembly 97 via inlets/outlets 103, 104. The arrangement is such that the supply of gas or hydraulic fluid to the sleeve assembly 97 via inlet/outlet 103, whilst the inlet/outlet 104 is open, acts against the annular surface 116 and causes the sliding pin 79 to move to the right from the unlocked position shown in FIG. 9 to the locked position shown in FIG. 10. In addition, the arrangement is such that the supply of gas or hydraulic fluid to the sleeve assembly 97 via inlet/outlet 104, whilst inlet/outlet 103 is open, acts against the annular surface 118 and causes the sliding pin 79 to move to the left from the locked position shown in FIG. 10 to the unlocked position shown in FIG. 9.

The locking pin moving means further comprises a radially mounted locking pin 106 which is received in a recess 107 in the sleeve assembly 97 when the locking pin 79 is in the locked position as shown in FIG. 10.

With reference to FIG. 25, an alternative form of the locking pin moving means comprises a housing 251 positioned between each pair of male and female members 57, 59 such that the associated locking pin 79 extends co-axially through the housing 251. The housing 251 defines an annular chamber 253, and an annular plate 255 connected to the locking pin 79 divides the chamber 253 into volumes 257*a*, 257*b*. The locking pin 79 moving means further comprises separate sources of compressed gas (not shown) which can be selectively connected via retractable valve/head assemblies 261*a*, 261*b* and conduits 263*a*, 263*b* to the volumes 257*a*, 257*b*.

In an alternative arrangement (not shown) the retractable valve/head assemblies 261*a*, 261*b* are not used and the source of compressed gas is connected manually to the conduits 263*a*, 263*b*.

The arrangement shown in FIG. 25 is such that when the valve/head assembly 261*a* is in a forward position and communicates with the conduit 263*a*, and the other valve/head assembly 263*b* is in a rearward position spaced from the conduit 263*b*, the compressed gas supplied along the conduits 261*a*, 263*b* causes volume 257*a* to expand and thereby moves the locking pin 79 into the locked position. Similarly, when the valve/head assembly 261*b* is in a forward position and communicates with the conduit 263*b*, and the other valve/head assembly 261*a* is in a rearward position spaced from the conduit 263*a*, the compressed gas supplied along the conduits 261*b*, 263*b* causes the volume 257*b* to expand and thereby moves the locking pin 79 into the unlocked position. An additional gas-actuated locking pin (not shown) is provided to hold the locking pin 79 in the unlocked or locked positions.

In an alternative arrangement the locking pin moving means comprises an accumulator (not shown) in the conduit 263*a* which stores a pre-charge of compressed gas that is released when the male members 57 are received in the female members 59 to cause sudden expansion of the volume 257*a* to move the locking pin 79 quickly into the locked position.

It is noted that the locking pin moving means may comprise any other suitable means, including mechanically actuated means.

The coupling means described in the foregoing description relates to the coupling together of adjacent conveyor units 13. A modified form of the coupling means is used to couple together the mining means 9 and the first conveyor unit 13.

With reference to FIG. 24, the modified coupling means comprises the coupling means as shown in FIGS. 3 to 8 and further comprises a link member 215 on each side of the mining means 9 which is pivotally connected at one end indicated by the arrow $P_1$ to the main frame of the mining means 9 and at the other end indicated by the arrow $P_2$ to the axle 53 of the rear wheel assembly of the mining means 9.

The highwall mining system further comprises a means for supplying electrical power to the conveying means 11.

With reference to FIG. 2 the electrical power supply means comprises the continuous electrical cable 25 which is wound onto the reel 101 on the launch platform 15 and is connected to the miner end of the mining means 9 and the conveying means 11.

During advance of the mining means 9 and the conveying means 11 into a seam 8 the electrical cable 25 is automatically fed from the reel 101 on the launch platform 15 and is guided into and supported by receptacles (not shown) in each conveyor unit 13 in the conveying means 11.

During withdrawal of the mining means 9 and the conveying means 11 from the seam 8 the electrical cable 25 is removed automatically from the receptacles in the conveyor units 13 and wound back on the reel 101 on the launch platform 15.

As a consequence, manual handling of these electrical cables and hoses is avoided.

With reference to FIGS. 4 and 5, the electrical power received at the miner end is distributed back along the conveying means 11 through cables 115 extending along the length of each conveyor unit 13 and electrical couplings 117, 119 at the end of each conveyor unit 13.

The electrical couplings 117, 119 on each conveyor unit 13 are arranged such that, when the male/female members 57, 59 of a new conveyor unit 13*a* engage the corresponding male/female members 57, 59 of the rearmost conveyor unit 13 of the conveying means 11, the electrical couplings 117, 119 on the new conveyor unit 13 also engage the rearmost conveyor unit 13 so that electrical power can be supplied via the rearmost conveyor unit 13 to power the belt or chain conveyor 51 of the new conveyor unit 13*a*.

The highwall mining system further comprises an on-board controller (not shown) on the launch platform 15 and microprocessors (not shown) on each conveyor unit 13. Control signals from the on-board controller and the microprocessors are transmitted through the various electrical cables using conventional methods of electrical control signal transmission including a down-line carrier system of transmission (not shown).

The microprocessor on the rearmost conveyor unit 13 on the conveying means 11 actuates the supply of electrical power to a new conveyor unit 13*a* after the new conveyor unit 13*a* is connected to the rearmost conveyor unit 13 after a series of pre-conditions have been satisfied. The conditions may include, by way of example:

(a) sensing completion of the engagement of the locking pins 79 to thereby complete mechanical coupling of the new conveyor unit 13*a* to the conveying means 11;

(b) sensing connection of the electrical cable coupling 117, 119, and (c) sensing the correct positioning of flame-proof equipment.

The main features of the above-described mechanical and electrical couplings of the highwall mining system are as follows:

(a) mechanical coupling:

(i) automatic, mechanized or manual operation of the locking pin 79—no manual handling of the locking pin 79;

(ii) automatically aligned for coupling by rack and pinion drive system and by guide (and "pinch") rollers on the launch platform 15;

(iii) coupling allows limited rotation around the conveyor unit axle centerline (this assists in the use of the rack and pinion drive system —the rack bars 43 pass over the centerline of the axle);

(iv) allows for one degree of freedom (vertical rotation around approximately horizontal axle) while minimized free-play in the other 5 degrees of freedom to facilitate:

(1) "roller chain" type action to follow the seam roll, (2) minimal longitudinal free play for control of conveyor/miner positions (viz. the relationship between freeplay, control and movement lag due to clearance take up) and axial forces;

(3) minimal lateral rotation or twisting in the horizontal plane to maintain straight alignment of the conveying means 11 (which is very important for maintaining pillar thicknesses and for the push-to-advance type drive system);

(4) minimum twisting or rotation in the vertical plane around the longitudinal axis of the conveying means 11 (to maintain overlapping conveyor pulley alignments); and (b) electrical coupling:

(i) aligned and coupled automatically (no manual handling and connection);

(ii) power to a new conveyor unit 13 is switched on automatically by control circuity (not by manually operated switch);

(iii) incorporates control cable (no separate cable—no manual handling and connection); and (iv) coincides with mechanical coupling.

The above described highwall mining system 3 has significant advantages over the known highwall mining systems.

Many modifications may be made to the preferred embodiment described above without departing from the spirit and scope of the present invention.

We claim:

1. A highwall mining system for mining aggregate material from a seam comprising:

(a) a mining means for cutting aggregate material from the seam and thereby forming a drive in the seam;

(b) a conveying means for conveying mined aggregate material from the drive, the conveying means comprising a plurality of modular conveyor units having a means for releasably coupling together the conveyor units;

(c) a driving means for driving the mining means and the conveyor means into the seam to form the drive; and (d) a controlling means for controlling forward movement of the mining means and the conveying means so that the mining means and the conveying means can move together at a predetermined rate of advance into the seam without there being any uncontrolled forward movement of the mining means and/or the conveying means in response to the incline of the seam and/or during the addition of a new conveyor unit to the conveying means.

2. The system defined in claim 1 wherein the coupling means is formed to allow limited relative rotation of adjacent conveyor units about a horizontal axis that is perpendicular to a longitudinal axis of the conveying means and substantially no relative rotation about a vertical axis.

3. The system defined in claim 2 wherein the coupling means is formed to allow limited relative rotation of adjacent conveyor units about the longitudinal axis of the conveying means.

4. The system defined in claim 3 wherein the coupling means is formed to allow substantially no relative translation of adjacent conveying units in longitudinal, horizontal and vertical directions.

5. The system defined in claim 2 wherein the limited relative rotation be no more than 20°.

6. The system defined in claim 5 wherein the limited relative rotation is no more than 8°.

7. The system defined in claim 1 wherein each conveyor unit comprises a belt or a chain conveyor extending over the length of the conveyor unit.

8. The system defined in claim 7 wherein each conveyor unit comprises a wheel assembly.

9. The system defined in claim 8 wherein each conveyor unit comprises a single wheel assembly.

10. The system defined in claim 1 wherein the coupling means comprises a male member and a complementary female member connected to the conveyor units such that the male member of one conveyor unit can be releasably received in the female member of an adjacent conveyor unit to couple together the conveyor units.

11. The system defined in claim 10 wherein each male member is coupled to an associated conveyor unit for pivotal movement about a horizontal axis of the conveyor unit.

12. The system defined in claim 11 wherein each conveyor unit comprises a wheel assembly and the horizontal axis is in the region of an axis of the wheel assembly.

13. The system defined in claim 1 wherein the controlling means is located externally to the drive.

14. The system defined in claim 1 wherein the driving means is located externally to the drive and arranged for pushing the mining means and the conveying means into the seam and for pulling the mining means and the conveying means from the drive.

15. The system defined in claim 14 further comprises a launch platform adapted to be positioned at the entrance to the drive and the launch platform comprises the driving means for pushing the mining means and the conveying means into the seam and for pulling the mining means and the conveying means from the drive.

16. The system defined in claim 1 further comprises a launch platform adapted to be positioned at the entrance to the drive and the launch platform comprises the controlling means.

17. The system defined in claim 16 wherein the launch platform further comprises a launch platform conveyor for receiving and discharging aggregate material from the end of the conveying means.

18. The system defined in claim 16 wherein the controlling means and the driving means are combined together to define a combined driving controlling means.

19. The system defined in claim 18 wherein the combined driving/controlling means comprises a rack and pinion drive assembly.

20. The system defined in claim 19 wherein the rack and pinion drive assembly comprises a rack bar mounted to at least one side of the mining mans and each conveyor unit and a drive pinion on the launch platform for engaging the rack bar.

21. The system defined in claim 20 wherein the rack and pinion drive assembly comprises a plurality of the drive pinions spaced apart in a line.

22. The drive system defined in claim 21 wherein the rack and pinion drive assembly comprises a rack bar on both sides of each conveyor unit and a plurality of drive pinions for engaging each rack bar.

23. The system defined in claim 18 wherein the combined driving/controlling means comprises a sliding plate assembly having a plate member located for sliding movement below the conveyor units on the launch platform and a drive means for sliding the plate member, with the plate member comprising a means for engaging the mining means and/or one of the conveyor units of the conveying means and/or a new conveyor unit to be added to the conveying means.

24. The system defined in claim 18 wherein the combined driving/controlling means comprises two sets of tandem drive cylinders, each set having one drive cylinder on each side of the conveying means, and the drive cylinders on each side of the conveying means being longitudinally aligned and spaced apart.

25. The system defined in claim 24 wherein the driving/controlling means further comprises a means for engaging one of the conveyor units coupled to each drive cylinder.

26. The system defined in claim 25 wherein the two sets of drive cylinders act co-operatively as a "walking" system to advance by pushing, and to withdraw by pulling, the mining means and the conveying means.

27. The system defined in claim 18 wherein the combined driving/controlling means comprises:

(a) a set of tandem drive cylinders with respective ones of the tandem drive cylinders on each side of the conveying means, each drive cylinder being moveable between a retracted and an extended position to advance by pushing, and to withdraw by pulling, the mining means and the conveying means;

(b) a first engaging means for engaging one of the conveying units coupled to each drive cylinder to allow the drive cylinders to advance and to withdraw the mining means and the conveying means; and (c) a second engaging means for engaging one of the conveyor units to hold the mining means and the conveying means in position while each drive cylinder is recycled (i) to the retracted position ready to further advance the mining means and the conveying means, or (ii) to the extended position ready to further withdraw the mining means and the conveying means.

28. The system defined in claim 1 wherein the controlling means and the driving means are combined together to define a combined driving/controlling means.

29. The system as defined in claim 1 and further including a means for electrically coupling a new conveyor unit to the end conveyor unit of the conveying means automatically as the new conveyor unit is moved toward the end conveyor unit.

30. The system as defined in claim 1 wherein said coupling means includes a locking means for automatically locking the conveyor units to one another as adjacent conveyor units are brought together.

31. A highwall mining system for mining aggregate material from a seam comprising:

(a) a mining means for cutting aggregate material from the seam and thereby forming a drive in the seam;

(b) a conveying means for conveying mined aggregate material from the drive, the conveying means comprising a plurality of modular conveyor units having a means for releasably coupling together the conveyor units, the coupling means comprising a male member and a complementary female member connected to the conveyor units such that the male member of one conveyor unit can be received in the female member of an adjacent conveyor unit to couple together the conveyor units, each conveyor unit comprising a wheel assembly, and each male member being coupled to an associated conveyor unit for pivotal movement about a horizontal axis of the conveyor unit that is coincident with an axis of the wheel assembly; and (c) a driving means for driving the mining means and the conveying means into the seam to form the drive.

32. A highwall mining system for mining aggregate material from a seam comprising:

(a) a mining means for cutting aggregate material from the seam and thereby forming a drive in the seam;

(b) a conveying means for conveying mined aggregate material from the drive, the conveying means comprising a plurality of modular conveyor units having a means for releasably coupling together the conveyor units, the coupling means comprising a male member and a complementary female member connected to the conveyor units such that the male member of one conveyor unit can be received in the female member of an adjacent conveyor unit to couple together the conveyor units, each male member being coupled to an associated conveyor unit for pivotal movement about a horizontal axis of the conveyor unit, each male member and each female member comprising cut-out sections that are arranged so that when the male member of one conveyor unit is received in the female member of an adjacent conveyor unit the cut-out sections form an opening that is transverse to the longitudinal direction of the conveying means; and (c) a driving means for driving the mining means and the conveying means into the seam to form the drive.

33. The system defined in claim 32 wherein the coupling means further comprises a locking pin that is moveable into the opening thereby to prevent disengagement of the male and the female members.

34. The system defined in claim 33 wherein the cut-out sections form a circular opening.

35. The system defined in claim 33 wherein the coupling means comprise a means for moving the locking pin into and from locking engagement in the opening.

36. The system defined in claim 35 wherein the coupling means comprises a pair of the male members on each side at one end and a pair of the female members on each side at the other end of each conveyor unit.

37. The system defined in claim 36 wherein the openings formed when, in use, the male members of one conveyor unit are received in the female members of an adjacent conveyor unit are aligned.

* * * * *